US011661801B2

(12) United States Patent
Benedict et al.

(10) Patent No.: US 11,661,801 B2
(45) Date of Patent: May 30, 2023

(54) ANTI-ROTATION COUPLING FOR USE IN A DOWNHOLE ASSEMBLY

(71) Applicant: Baker Hughes Oilfield Operations, LLC, Houston, TX (US)

(72) Inventors: Detlev Benedict, Celle (DE); Volker Peters, Celle (DE); Hanno Reckmann, Celle (DE); Ingo Roders, Celle (DE)

(73) Assignee: BAKER HUGHES OILFIELD OPERATIONS, LLC, Houston, TX (US)

( * ) Notice: Subject to any disclaimer, the term of this patent is extended or adjusted under 35 U.S.C. 154(b) by 193 days.

(21) Appl. No.: 16/925,966

(22) Filed: Jul. 10, 2020

(65) Prior Publication Data

US 2021/0010332 A1 Jan. 14, 2021

Related U.S. Application Data

(60) Provisional application No. 62/873,067, filed on Jul. 11, 2019.

(51) Int. Cl.
*E21B 17/046* (2006.01)
*E21B 17/042* (2006.01)

(52) U.S. Cl.
CPC ..... *E21B 17/046* (2013.01); *E21B 17/0423* (2013.01)

(58) Field of Classification Search
CPC ..... E21B 17/046; E21B 17/03; E21B 17/04
See application file for complete search history.

(56) References Cited

U.S. PATENT DOCUMENTS 1,781,091 A * 11/1930 Wilson ..... E21B 17/046
7,146,704 B2 12/2006 Otten et al.
(Continued)

FOREIGN PATENT DOCUMENTS

EP 1211451 A1 6/2002
GB 2531555 A * 4/2016 ..... E21B 17/06
(Continued)

OTHER PUBLICATIONS

Reyher, "Locking of bolted Joints", Reyner Engineering Management, pp. 1-16, Hamburg, Germany.
(Continued)

*Primary Examiner* — Zachary T Dragicevich
(74) *Attorney, Agent, or Firm* — Bracewell LLP; Keith R. Derrington

(57) ABSTRACT

A downhole assembly that includes tubulars rotationally coupled to one another. An interface is between adjacent tubulars that makes up at least a portion of the rotational coupling. Certain surfaces of adjacent tubulars come into contact with one another when adjacent tubulars are rotationally coupled; and which are defined as contact surfaces. Each contact surface is profiled with facets that are complementary to facets on a corresponding contact surface of an adjacent tubular. The profiling of the contact surfaces is such that when a contact surface is brought together with a corresponding contact surface; facets on the contact surface abut facets on the corresponding contact surface along planes that are oblique or parallel with an axis of the tubular. At least some of a rotational torque transmitted between adjacent tubulars occurs across the abutting facets.

9 Claims, 10 Drawing Sheets

(56) References Cited

U.S. PATENT DOCUMENTS

| | | | | |
|---|---|---|---|---|
| 8,375,995 | B2 | 2/2013 | Courtois et al. | |
| 8,950,785 | B2 | 2/2015 | Raynal et al. | |
| 9,708,865 | B2 | 7/2017 | Steen et al. | |
| 10,597,950 | B2 | 3/2020 | McGowan et al. | |
| 2005/0279513 | A1 | 12/2005 | Eppink | |
| 2006/0267342 | A1* | 11/2006 | Boyd | E21B 17/04 |
| 2014/0231144 | A1 | 8/2014 | Satish et al. | |
| 2018/0171724 | A1* | 6/2018 | Daigle | E21B 17/046 |

FOREIGN PATENT DOCUMENTS

| | | | | |
|---|---|---|---|---|
| JP | 2018123616 | A | 8/2018 | |
| WO | 2009111887 | A1 | 9/2009 | |
| WO | WO-2016164973 | A1 * | 10/2016 | E21B 17/046 |

OTHER PUBLICATIONS

Sean Thomas, "Threaded Locking Methods for Secure Connections", Mechanical Design, Mar. 21, 2017, pp. 1-20.
ESPACENET English Abstract of JP2018-123616, published Sep. 8, 2018, 1 page.
PCT International Search Report dated Oct. 23, 2020, in the prosecution of patent PCT/US2020/041698, 10 pages.

* cited by examiner

ANTI-ROTATION COUPLING FOR USE IN A DOWNHOLE ASSEMBLY

RELATED APPLICATIONS

This application claims priority to and the benefit of U.S. Provisional Application Ser. No. 62/873,067 filed on Jul. 11, 2019, which is incorporated by reference herein in its entirety and for all purposes.

BACKGROUND OF THE INVENTION

1. Field of Invention

The present disclosure relates to an anti-rotation coupling between opposing surfaces of adjacent members of a downhole assembly. More specifically, the present disclosure relates to an interface between adjacent members that is formed by complementary profiles on opposing surfaces of the members of the downhole assembly.

2. Description of Prior Art

A number of devices for use in hydrocarbon producing wells employ tubular members coupled together with threaded connections. Tubular members making up a drill string are usually joints of pipe connected together with box and pin type connections which usually include shoulders adjacent the bases of their respective threaded portions. Typically, most of the torque loads transmitted between adjacent joints of pipe travels is transmitted across the threaded connections, while a smaller portion is transmitted across the box and pin shoulders. Some tubular members have other types of threaded connections which transmit a majority of the load across surfaces of the joined members that are in contact with one another. Frictional forces between the abutting surfaces keeps adjacent tubulars rotationally engaged. One drawback of transmitting torque loads across abutting surfaces is that sometimes the torque loads exceed the frictional forces, which allows relative rotation between adjacent tubulars causing the surfaces to be in sliding contact with one another. Due to the sliding contact, it is possible to introduce excessive torque into the connection; or conversely, loosen the connection. Moreover, the respective areas of the contact surfaces are generally smaller than that of a typical threaded connection, thereby subjecting the surfaces to greater unit forces than what is exerted on the threaded portion. Metal fatigue and localized fractures are types of damage experienced due to sliding contact. These types of damage may be especially problematic when the loads are cyclic, or are from high frequency torsional oscillations ("HFTO").

SUMMARY OF THE INVENTION

Disclosed is an example of a downhole assembly that includes a drill bit, a tubular member, a shaft connected to the drill bit and configured to rotate within and relative to the tubular member to rotate the drill bit, and the shaft having a first shaft member with a first engagement area and a second shaft member with a second engagement area, the first and second engagement areas engaged with each other by a threaded connection, wherein at least one of the first and second engagement areas include one or more torsional locking elements. The one or more torsional locking elements alternatively include raised members on at least one of the first and second engagement areas. The threaded connection is optionally a connection with a compression element. In one embodiment, the shaft and the tubular member are coupled by one or more bearings between the shaft and the tubular member. In an example, the first and second engagement areas are under compression when engaged. The one or more torsional locking elements optionally include particles on of one of the first and second engagement areas and that press into the other of the first and second engagement areas when the first and second engagement areas are engaged. In an embodiment the threaded connection has an outer diameter and the tubular member has an inner diameter and the outer diameter of the threaded connection is smaller than the inner diameter of the tubular member. Examples of the assembly include a drilling motor having a stator and a rotor and with the shaft connected to the rotor. The second shaft member is optionally a ring element further including a third engagement area; and the shaft includes a third shaft member having a fourth engagement area, the third engagement area engaged with the fourth engagement area; and the one or more torsional locking elements are made of material that is harder than at least one of the first, the second, and the third shaft members. The first and second engagement areas are optionally at a distance of less than 5 m to the drill bit.

Also included is an example of a method to drill into a formation of the Earth that includes conveying a drilling assembly into a borehole, the drilling assembly having a tubular member and a drill bit, the drill bit in contact with the formation, rotating the drill bit in contact with the formation with a shaft connected to the drill bit, the shaft configured to rotate within and relative to the tubular member, the shaft equipped made up of a first shaft member with a first engagement area and a second shaft member with a second engagement area, and at least one of the first and second engagement areas having one or more torsional locking elements. The example method also includes engaging the first and second engagement areas with each other by a threaded connection. In an alternative, the one or more torsional locking elements have raised members on at least one of the first and second engagement areas, and optionally the threaded connection is a connection with a compression element. In an alternative, the method includes coupling the shaft and the tubular member by one or more bearings between the shaft and the tubular member. In some instances the first and second engagement areas are under compression when engaged. The one or more torsional locking elements optionally include particles on of one of the first and second engagement areas, and the particles press into the other of the first and second engagement areas when the first and second engagement areas are engaged. In an embodiment, the threaded connection has an outer diameter and the tubular member has an inner diameter and the outer diameter of the threaded connection is smaller than the inner diameter of the tubular member. Examples exist that the assembly includes a drilling motor having a stator and a rotor, and with the shaft connected to the rotor. In an example, the second shaft member is a ring element further having a third engagement area, the shaft having a third shaft member with a fourth engagement area that is engaged with the third engagement area, and the one or more torsional locking elements are made of material that is harder than at least one of the first, the second, and the third shaft members. In an example, the first and second engagement areas are at a distance of less than 5 m to the drill bit.

BRIEF DESCRIPTION OF DRAWINGS

Some of the features and benefits of the present invention having been stated, others will become apparent as the description proceeds when taken in conjunction with the accompanying drawings, in which:

FIG. 2D is a side view of an alternate example of tubulars of FIG. 2A having a ring disposed between.

Figure 1:
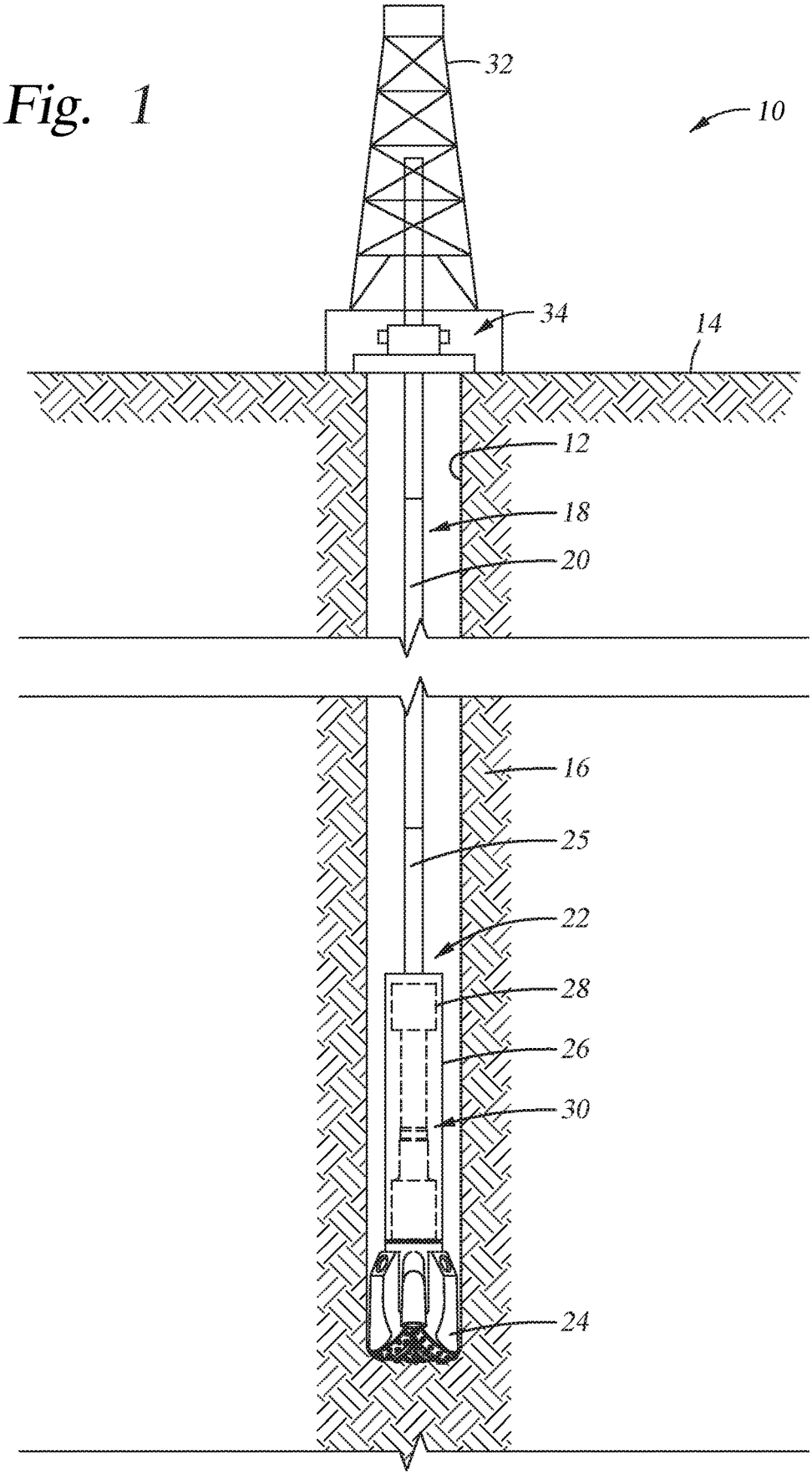
FIG. 1 is a partial side sectional elevational view of an example of excavating a wellbore.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout. The use of the terms and similar references in this description (especially in the context of the following claims) "above", "up", "high" "upper", and "upwards" are to be construed to mean between a referenced location and the surface of the Earth along the bottom-hole assembly or the drill pipes, and the terms and similar references "below", "down", "low", "lower", and "downwards" are construed to mean on a side opposite a referenced location and surface of the Earth along the bottom-hole assembly or the drill pipes. In an embodiment, usage of the term "about" includes +/−5% of a cited magnitude. In an embodiment, the term "substantially" includes +/−5% of a cited magnitude, comparison, or description. In an embodiment, usage of the term "generally" includes +/−10% of a cited magnitude.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

As noted above, some connections between components that make up a drill string or a drilling tool include box and pin type connections, alternatives of which have shoulders adjacent the bases of their respective threaded portions and are referred to as Rotary Shouldered Thread Connections ("RSTC"). In an embodiment, the torsional load capacity of a RSTC depends on preloads at the shoulders (e.g. outer shoulders close to the outer diameter of pin and box) and at the threads, as well as friction on the preloaded surfaces of the shoulders and the threads that are in contact with one another. Another type of connection is referred to as a Double-Shouldered Connection ("DSC") also has inner shoulders that increase the number of preloaded surfaces and the amount of total preload, that in turn increases frictional torque capacity. The ultimate torque capacity of the DSC is approximately the sum of frictional torque capacities at the shoulders and at the threads—each often being in the same order of magnitude (e.g. about 45%). The pitch of the thread usually has no more than a minor contribution to the torque capacity.

At high torque loads rotational sliding is possible between the outer shoulders of a pin and box connection. Relative movement between these members sometimes is in the range of about 0.01 mm to 0.1 mm or more. After assembly and make-up of the connection a portion of the operating torque is transmitted through the box outer shoulder; and which often is the major part of the total torque acting at the connection. This is thought to be the result of a higher torsional stiffness of the box compared to the pin. Because the frictional torque capacity of the outer shoulder is limited, sliding occurs at the outer shoulder above a certain torque value. However, this torque value causing the sliding is still below the ultimate limit of the connection (i.e. below the yield torque or below the break-out-torque depending on the direction of the torque).

Additional inner shoulders at pin and box (as in case of DSC) may increase the ultimate torque capacity. However, the torque load threshold value that causes sliding at the outer shoulders is the same for a connection without inner shoulders. In this scenario, values of other parameters are unchanged, such as stiffness, preload and coefficient of friction at the outer shoulders. Such sliding during drilling operations may cause significant problems, such as; wear, galling and heating at shoulders, loss of preload, leakage, metal fatigue, and fracture. This is particularly an issue during cyclic torque loading, such as torque oscillating between a minimum and a maximum value occurring during Torsional Oscillations, such as High Frequency Torsional Oscillations ("HFTO", i.e. torsional oscillation with a frequency higher than approximately 10 Hz, such as higher than 30 Hz or 50 Hz) or stick/slip phenomena, which may cause a large number of such sliding events to occur back and forth and possibly at high frequencies. At loads above the sliding torque value sliding is possible along contact surfaces between threads and the inner shoulders, which can introduce additional undesirable effects of over-load, plastic deformations, fracture, or loosening. With regard to above described mechanism and challenges, a particular situation exists for example for Rotary Steerable Systems ("RSS") and drilling motors. Such tools typically have a connection between components of a drive shaft which is mounted and rotating within a housing and transmits drilling torque to the drill bit. Borehole size limits the housing diameter that in turn limits the available diameter for this connection; which in turn reduces available cross sections and radii, and limits maximum preloads and the frictional torque capacity of connection designs such as those for the RSTC and DSC. Such a connection may not be as strong as the other connections in the drill string (not covered by a housing), it may therefore be particularly prone to above described failures and negatively affect reliability or performance of drilling operations.

Illustrated in FIG. 1 is a side partial sectional view of a drilling assembly 10 forming a wellbore 12 from surface 14 and downward through a subterranean formation 16. The drilling assembly 10 includes an elongated drill string 18 shown made up of individual drill pipes 20 that are connected at individual joints. A bottom-hole assembly 22 (also referred to as a downhole assembly) is depicted mounted on a lower end of drill string 18 and fitted with a drill bit 24 on its lower end. In an example, a fluid is pumped or circulated through an inner bore 25 of string 18 that extends through drill pipes 20 and through components of the bottom-hole assembly 22. The fluid flows through the drill bit 24 to lubricate and cool drill bit 24 and to remove cuttings that may be created by rotating drill bit 24 at the bottom of wellbore 12; example fluids include wellbore fluid, drilling fluid, drilling mud, and combinations. In the example of FIG. 1 the bottom-hole assembly 22 includes a housing 26, a motor 28, and connection assembly 30. Motor 28 is schematically shown in dashed outline within housing 26, and connection assembly 30 couples the drill bit 24 with an output from the motor 28. Examples of the motor 28 include a displacement motor that provides a rotational force or torque in response to the wellbore fluid flowing through motor 28. In the illustrated example motor 28 rotates connection assembly 30 and attached drill bit 24. A rotational torque is delivered from motor 28 to drill bit 24 through connection assembly 30 for forming wellbore 12. On surface 16 is a derrick 32 over an opening of wellbore 12, and which provides support for devices and equipment used in wellbore operations. A surface means (not shown) is alternatively included for rotating drill string 20 and drill bit 24. In one example surface means include a top drive with rotary table rotated by a prime mover such as an electric motor to rotate drill bit 24, and are used together with motor 28 or for bottom-hole assemblies 22 that do not include a motor 28. Alternatively, drill bit 24 is rotated by motor 28 alone and without surface means to rotate drill bit 24 or by only surface means to rotate drill bit 24 and without motor 28. A wellhead assembly 34 is shown set over the opening of wellbore 12, and which provides pressure control for wellbore 12. In an example, downhole assembly 22 is a rotary steering system.

Figure 2A:
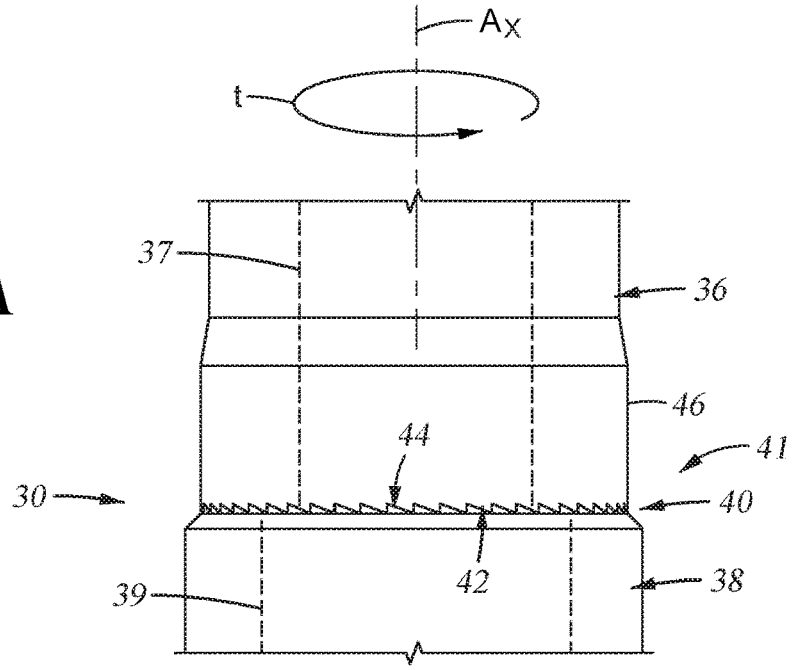
FIG. 2A is a side view of an example of end portions of tubulars rotationally coupled together.
Figure 2B:
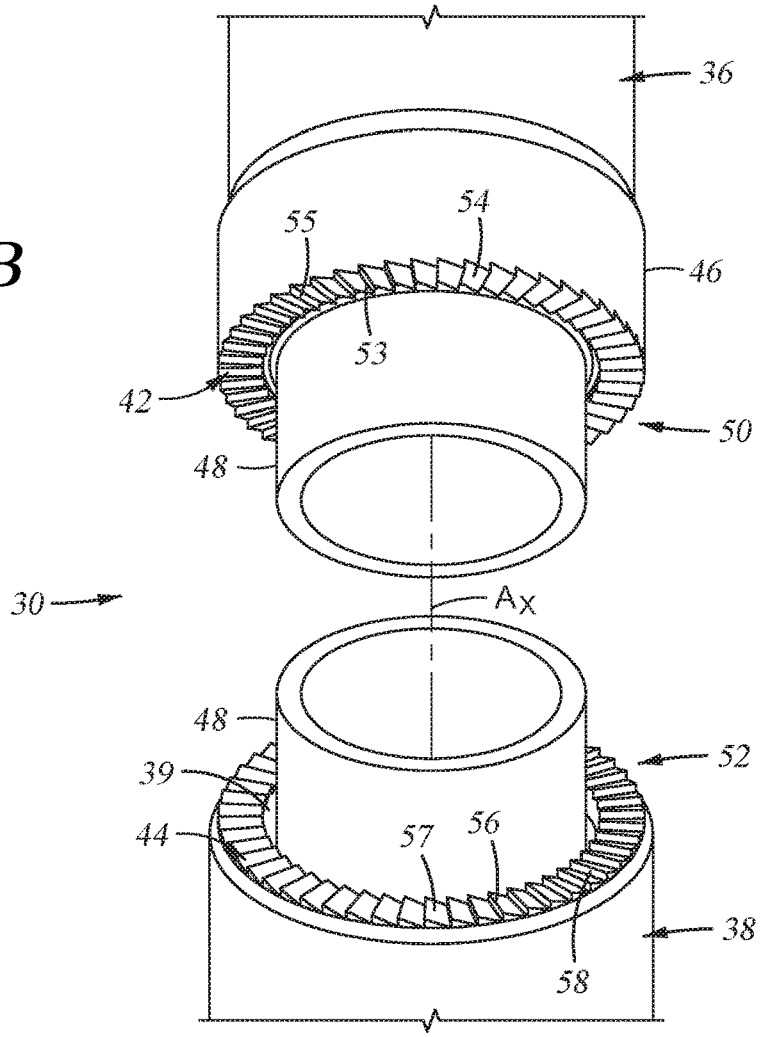
FIG. 2B is a perspective view of examples of contact surfaces of the tubulars of FIG. 2A.
Figure 2D:
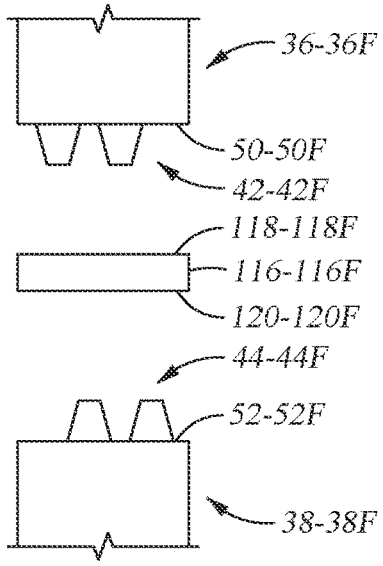
Figure 2C:
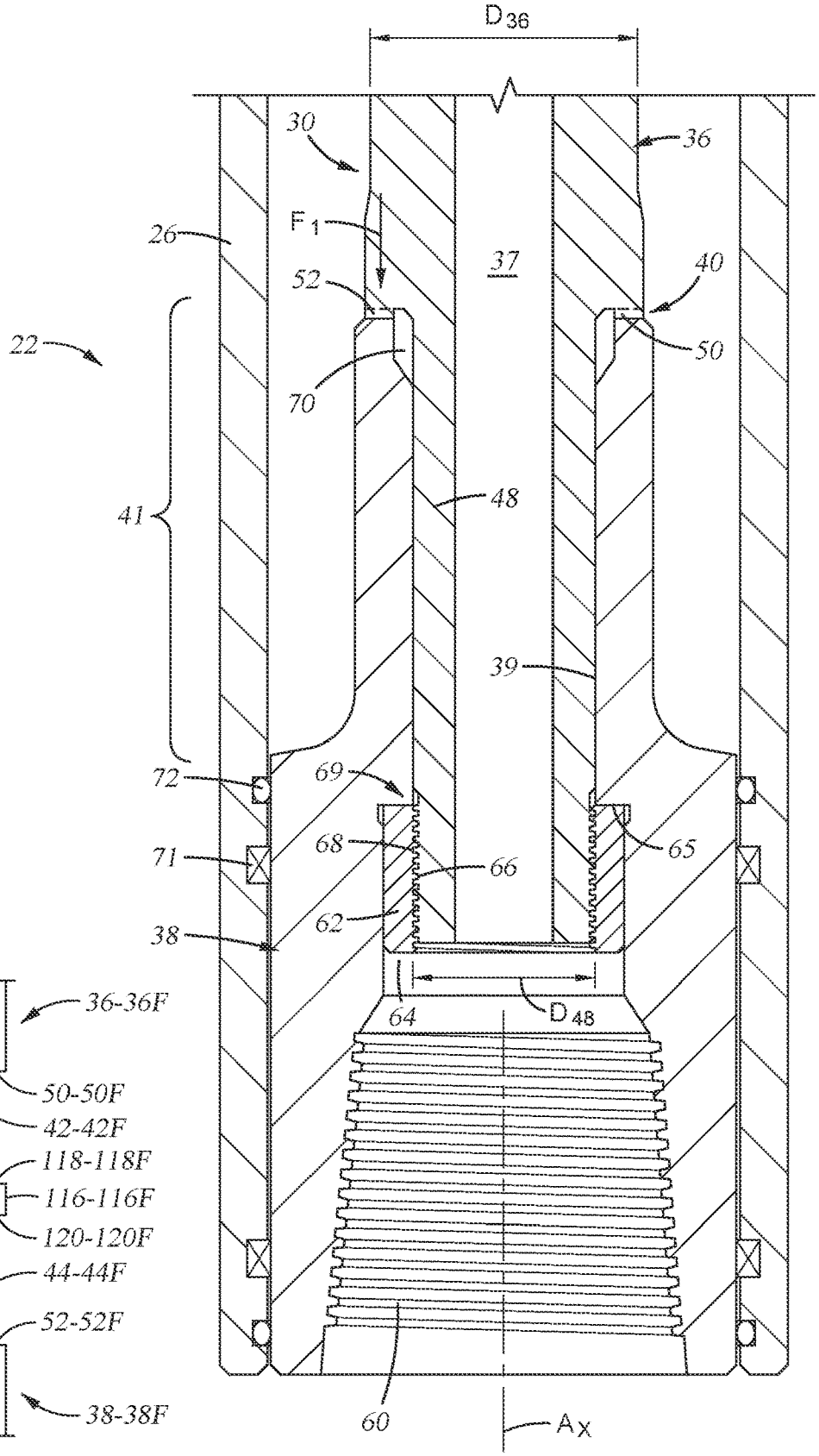
FIG. 2C is a side sectional view of an example of end portions of tubulars of FIG. 2A disposed in a housing.

In an alternative, bottom-hole assembly 22 is modular, and optionally includes a plurality of subcomponents, such as a drill bit (the same or similar to drill bit 24), a steering assembly, a motor (the same or similar to motor 28), a bend motor, one or more measurement tools, one or more stabilizers, one or more reaming tools, one or more drive shafts, and the like. In an embodiment, the measurement tools measure characteristics of the formation, the wellbore trajectory, a drilling direction, or operational parameters of the drilling process (such as logging-while-drilling or measurement while drilling tools, also referred to as LWD or MWD tools. The one or more drive shafts convey torque from one subcomponent to another one, and may be optionally utilized if portions of a subcomponent rotate at different rotational velocities. In a non-limiting example, a steering assembly includes a drive shaft that rotates within a sleeve that is static or rotates at a rotational velocity slower than the drive shaft. Alternatively a motor, such as motor 28, includes a rotor that selectively rotates within a stator that is static or rotating at a rotational velocity slower than or substantially different than the rotor. In an embodiment, drill pipes 20 or subcomponents of bottom-hole assembly 22 including parts of subcomponents, such as portions or members of drive shafts, are joined together by threaded connections, for example by threaded connections that are symmetric with respect to the longitudinal axis of the drill pipes 20 or subcomponents of bottom-hole assembly 22. A detailed example of a connection assembly 30 is shown in a side view in FIG. 2A. As shown, connection assembly 30 includes an annular upper subcomponent 36 having an inner bore 37 shown extending along axis $A_X$, and an annular lower subcomponent 38 also with an inner bore 39 shown extending along axis $A_X$. In an alternative, bore 37 is in communication with bore 25 (FIG. 1) and bore 39, and fluid, such as wellbore fluid, drilling fluid, and/or drilling mud flows through bores 25, 37, 39 to drill bit 24. In the example shown, a lower end of upper subcomponent 36 engages an upper end of lower subcomponent 38 along an example of a link 40. In an embodiment, link 40 is part of a connection 41 that rotationally couples the subcomponents 36, 38. Link 40 as illustrated is made up a series of raised members 42, 44 respectively formed on the opposing faces of upper subcomponent 36 and lower subcomponent 38. In a non-limiting example, raised members 42, 44 are formed by knurling. The members 42, 44 are strategically profiled and complementarily fashioned so that when the upper and lower subcomponents 36, 38 are engaged as depicted in FIG. 2A, the members 42, 44 become intermeshed with one another. A flared portion 46 is formed on a section of upper subcomponent 36 proximate link 40, and which has an outer diameter greater than a remaining section of upper subcomponent 36 shown. Referring to FIG. 2B, perspective views of the upper and lower subcomponents 36, 38 are shown, and which illustrate an elongated stinger 48 included with upper subcomponent 36 extends along axis $A_X$ past link 40 into lower subcomponent 38. Illustrated in FIG. 2B and side sectional view in FIG. 2C, upper subcomponent 36 has an outer diameter less than an inner diameter of flared portion 46. A shoulder 50 is defined on a radial surface of flared portion 46 that faces lower subcomponent 38 and makes up a part of link 40. A corresponding shoulder 52 is shown on a radial surface of lower subcomponent 38 which faces upper subcomponent 36. In the examples illustrated, raised members 42, 44 are respectively provided on shoulders 50, 52; and that project axially from shoulders 50, 52. As illustrated in the examples of FIGS. 2A and 2C, shoulders 50, 52 each lie in planes that are substantially perpendicular with axis $A_X$, and raised members 42, 44 define projections that extend towards the opposing one of the shoulders 50, 52 and in a direction generally parallel with axis $A_X$. The raised members 42 shown in the embodiment of FIG. 2B are disposed adjacent one another and substantially covering the shoulder 50. In an alternate embodiment spaces (not shown) are disposed between adjacent raised members 42, and where the radial surface of the shoulder 50 in one or more of the spaces lies in a plane substantially perpendicular to axis $A_X$.

Shown in detail in FIG. 2B is one example of a portion of a row of raised members 42. As shown, raised members 42 each have an end distal from shoulder 50 that defines a tip 53, and facets 54, 55 on their lateral sides that project axially from shoulder 50 and converge to the tip 53. In the example illustrated, tip 53 extends along a line that extends radially from axis $A_X$. Facet 54 is oriented in a plane that is oblique with axis $A_X$, whereas facet 55 is in a plane that is generally parallel with axis $A_X$; that in combination with facet 54 resembles a saw-tooth profile for the raised members 42 on shoulder 50. A detail of raised members 44 also depicts members 44 having a tip 56 extending radially from axis $A_X$, a facet 57 in a plane oblique with axis $A_X$, and a facet 58 in a plane generally parallel with axis $A_X$. An advantage of the profiling of raised members 42, 44 on shoulders 50, 52 is that at least a portion of the rotational torque t transmitted between the upper and lower subcomponents 36, 38 is transferred across link 40 and by the strategic profiling of the members 42, 44. An additional advantage of the profiles on the raised members 42, 44 on shoulders 50, 52 is that the opposing facets 55, 58 define locking elements, for example rigid locking elements, at the shoulders 50, 52; in a non-limiting example the locking elements provide a means for increasing an amount of torque transmitted between shoulders 50, 52, such as when subcomponents 36, 38 are rotationally engaged with one another. In an example, engaging the lateral surfaces of opposing facets 55, 58 transmits torque loads across shoulders 50, 52 that are greater than torque loads transmittable with a convention RSTC, thereby preventing rotational sliding between the upper and lower subcomponents 36, 38. In an example adhesives are not used between shoulders 50, 52 (i.e. shoulders 50, 52 are purely mechanically connected) and the threaded connection are repeatedly opened and closed rendering the connection 41 being removable. In an example, the threaded connection are repeatedly mechanically opened and closed and without breaking or removing an adhesive. In an example, lateral sides of the raised members 42, 44 define those surfaces which are in planes that are either parallel with or oblique with axis $A_X$.

Illustrated in FIG. 2C is that stinger 48 is received within a bore 59 that extends axially through the lower subcomponent 38. An end of bore 59 distal from upper subcomponent 36 tapers radially outward and is fitted with threads 60 to receive corresponding threads (not shown) of another subcomponent, such as drill bit 24 in FIG. 1 a steering assembly, a motor (e.g. motor 28), a tool to measure characteristics of the formation, the wellbore trajectory, a drilling direction, operational parameters of the drilling process, a logging-while-drilling tool, a measurement while drilling tool, a stabilizer, a reaming tool, a drive shaft, or drive shaft member, and the like. In the example of FIG. 2C, an annular torque nut 62 is used to couple together upper and lower subcomponents 36, 38. In an example torque nut 62 operates as a compression element. Torque nut 62 is set within an annular space 64 shown circumscribing a portion of bore 59 and stinger 48. Annular space 64 is in the body of lower subcomponent 38, an end of annular space 64 is defined where bore 59 abruptly increases in diameter to form a ledge 65 that faces away from shoulder 50. Further in this example, torque nut 62 acts as a fastener to couple together upper and lower subcomponents 36, 38 and includes threads 66 on its inner radial surface that engage threads 68 formed on an end of stinger 48 along its outer surface. Engaging corresponding sets of threads 66, 68 and rotating torque nut 62 in a designated rotational direction draws stinger 48 towards threads 60, that in turn urges shoulder 50 of the upper subcomponent 36 towards and into compressive contact with shoulder 52 of lower subcomponent 38; in this example shoulders 50, 52 are engaged without rotating either of shoulders 50, 52 about axis $A_X$. The compressive contact between shoulders 50, 52 generates force Fi shown exerted axially along shoulder 50 and against shoulder 52. The magnitude of force Fi is dependent upon a rotation of and torque applied to torque nut 62 when engaging threads 66, 68, and increases with further rotation of torque nut 62 in a direction that applies tension to stinger 48. Ledge 65 limits axial travel of torque nut 62, and exerts a force to torque nut 62, which is transferred via threads 66, 68 to result in force $F_1$. Engaging threads 66, 68 with one another forms a threaded connection 69, which in an example is included as part of connection 41.

Still referring to FIG. 2C, as illustrated the outer diameter $D_{48}$ of stinger 48 and that of threads 66, 68 are less than the outer diameter $D_{36}$ of upper subcomponent 36. The threshold value of the force $F_1$ to rotationally affix the upper and lower subcomponents 36, 38 is lower when torque is transferred across the link 40 than when known tubular couplings are employed; such as a standard box and pin connection. One of the advantages provided by the lower torque requirement is that the dimensions (such as diameter and length) of the torque nut 62 are also lowered, which results in less weight and cost. The raised members 42, 44 utilize existing contact surfaces between the upper and lower subcomponents 36, 38 to increase an area of the interface of force transfer between the upper and lower subcomponents 36, 38; and also magnitudes of resultant forces transferred between the subcomponents 36, 38. By expanding the force transfer interface to include force transfer across the raised members 42, 44, in turn increases the rotational force and torque that is transferred between the upper and lower subcomponents 36, 38. The addition of the corresponding raised members 42, 44 thereby increase the size and capabilities of the interface of force transfer, and thereby provide the advantage of reducing the chances or amount of sliding, and avoiding a connection that is loose. Included in the example of FIG. 2C is a groove 70 shown formed along an inner surface of lower subcomponent 38 at an end adjacent the shoulder 52, as illustrated groove 70 limits an engagement area of shoulders 50, 52 and reduces the maximum stress level at and around link 40. In embodiments with the groove 70 that reduces engagement area of shoulders 50, 52 the pre-compression applied to link 40 without exceeding stress limits at engagement areas. The presence of groove 70 also increases an average diameter of where shoulders 50, 52 are engaged, which in turn increases a maximum magnitude of torque transmitted between subcomponents 36, 38 across link 40 and without relative movement between shoulders 50, 52. The size of groove 70 has to be defined by carefully balancing the various effects which may be calculated by an optimization algorithm to determine a size or range of sizes of groove 70 for particular applications, example sizes of a radius of groove 70 include up to about 3 mm, up to about 5 mm, and up to about 7 mm.

Further depicted in the example of FIG. 2C is the housing 26 circumscribing the upper and lower subcomponents 36, 38. As shown, housing 26 is a generally annular member and which bearings 71 are housed within an inner radius of housing 26 to facilitate for the rotation of upper and lower subcomponents 36, 38 with respect to housing 26, example embodiments of bearings 71 include radial and axial type bearings. In the example of FIG. 2C subcomponents 36, 38 are respectively shown as upper and lower portions of a drive shaft, which in an example rotate within housing 26 and transmit torque to for rotating drill bit 24 (FIG. 1). In alternatives housing 26 is rotationally static, or rotating at a lower rotational velocity than subcomponents 36, 38. Further, seals 72 are optionally illustrated that provide a pressure barrier to fluids ambient to the bottom-hole assembly 22, such as drilling or other wellbore fluids within a wellbore. Embodiments exist without a seal between housing 26 and subcomponents 36, 38 to allow fluid, e.g. wellbore fluid or drilling fluid, to flow around subcomponents 36, 38 in addition to or as an alternative to fluid flowing through bores 37, 39 in subcomponents 36, 38. In an alternate embodiment (not shown), housing 26 terminates above lower subcomponent 38; and optionally the respective outer diameters of housing 26 and lower subcomponent 38 are substantially the same. This alternative embodiment allows for a larger outer diameter of torque nut 62, and/or increased cross sections and axial loads (like a preload) acting at locking elements (at respectively engaged surfaces). Advantages exist for a high axial (pre-) load to transfer high torque or torsional loads as well as bending without sliding or losing contact. Optionally, with larger diameters at the lower end of the lower subcomponent 38 additional advantages are realized of greater strength of the drill bit connection or "bit box", and alternatively disposed at threads 60 to receive corresponding threads (not shown) of another component.

Figure 3A:
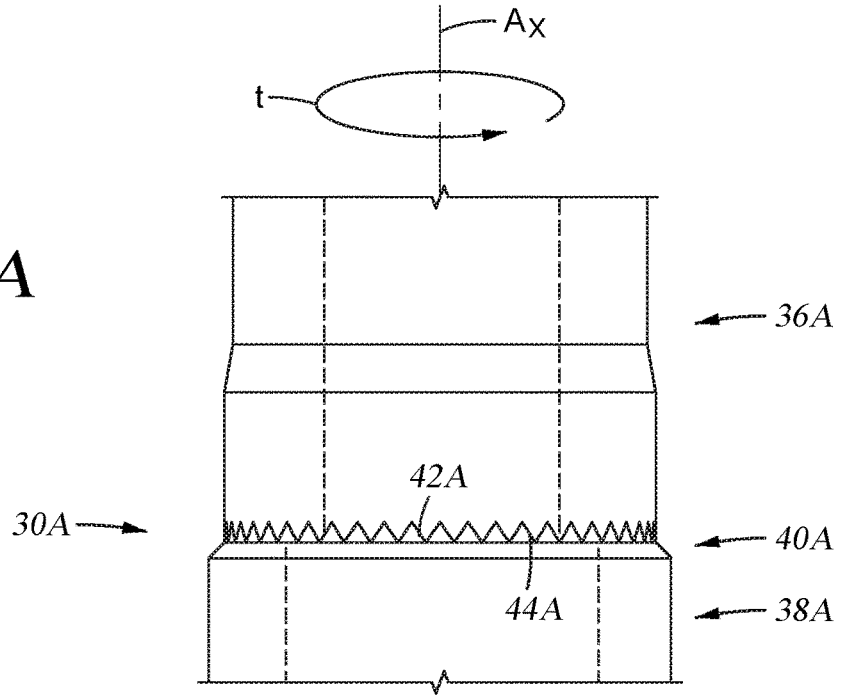
FIG. 3A is a side view of an alternate example of end portions of tubulars rotationally coupled together.
Figure 3B:
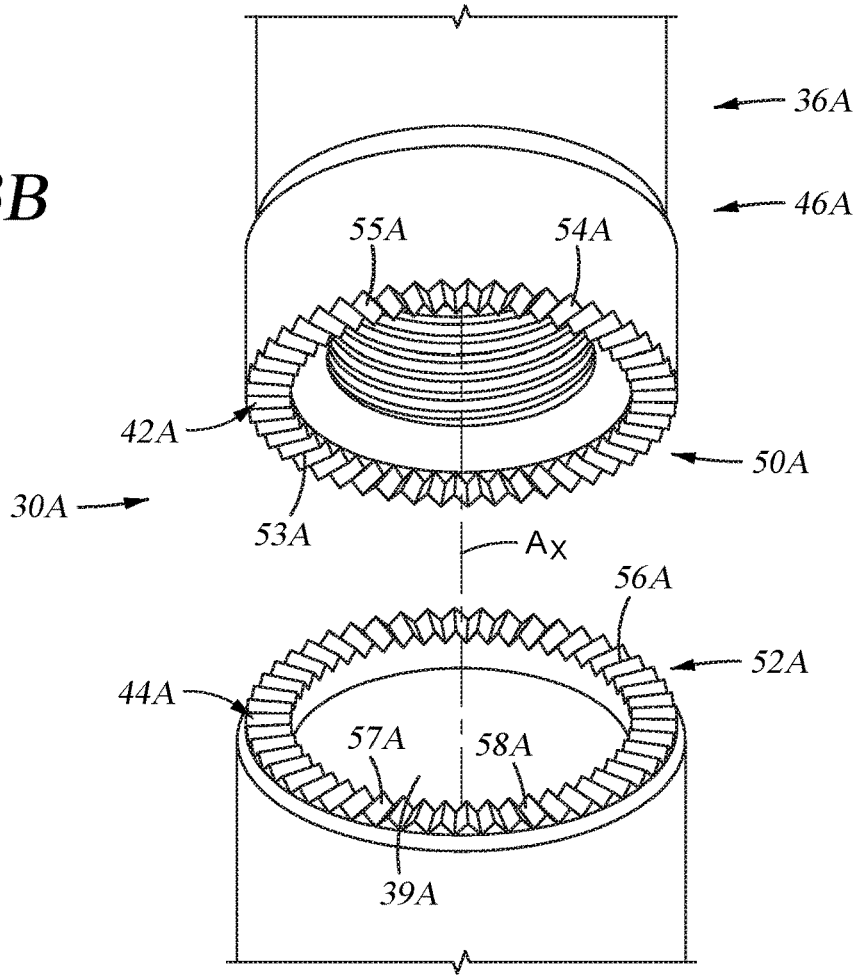
FIG. 3B is a perspective view of examples of contact surfaces of the tubulars of FIG. 3A.
Figure 3C:
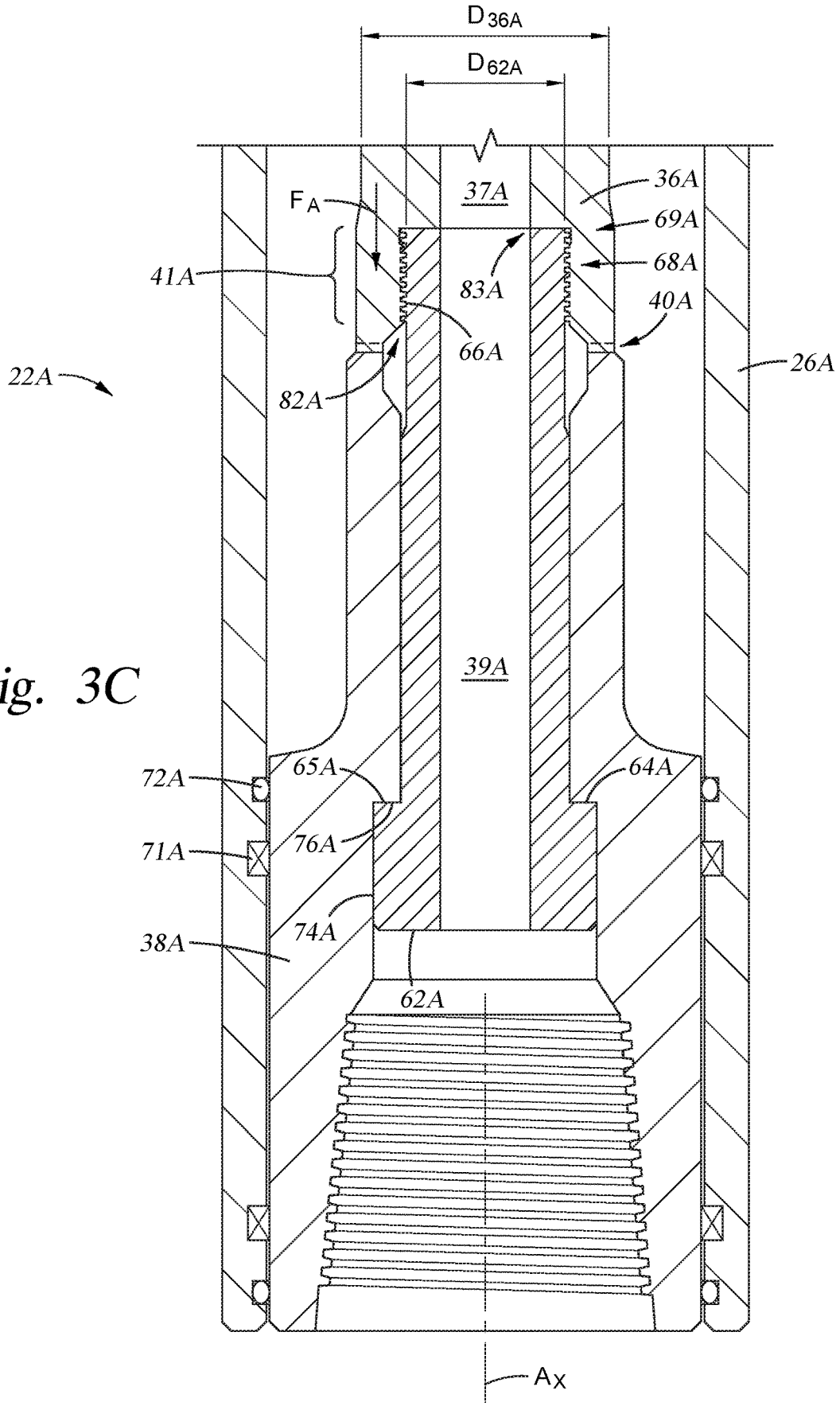
FIG. 3C is a side sectional view of an example of end portions of tubulars of FIG. 3A disposed in a housing.

An alternate embodiment of connection assembly 30A and bottom-hole assembly 22A is shown in FIGS. 3A, 3B, and 3C. Shown in side view in FIG. 3A, and similar to the embodiment of FIG. 2A, raised members 42A, 44A respectively located on the upper and lower subcomponents 36A, 38A are intermeshed with one another to form a link 40A across which a rotational torque is transferred between upper and lower subcomponents 36A, 38A. Referring to FIG. 3B, a perspective view of connection assembly 30A is provided in a perspective view. Details of the raised members 42A, 44A are shown in FIG. 3B illustrating that planar surfaces on the members 42A, define facets 54A, 55A, and that planar surfaces on members 44A define facets 57A, 58A. In the example shown, facets 54A, 55A are angularly offset from and generally oblique to axis $A_X$, and the angular offset between axis $A_X$ and facets 54A is substantially the same as the angular offset between axis $A_X$ and facets 55A. As shown, axis $A_X$ extends longitudinally along connection assembly 30A and in examples of operation connection assembly 30A rotates about axis $A_X$. Further in this example, facets 57A, 58A are also angularly offset from and generally oblique to axis $A_X$, and with angular offsets that are substantially the same. Tips 53A are formed where facets 54A, 55A join, and tips 56A are formed where facets 57A, 58A join, tips 53A, 56A are shown extending generally radially from axis $A_X$. In an example, raised members 42A, 44A are in a configuration commonly referred to as Hirth teeth. In similar fashion, rotation of one of the upper or lower subcomponents 36A, 38A transmits a rotational torque across link 40A from interaction of the facets 54A, 55A on shoulder 50A and facets 57A, 58A of raised members 56A on shoulder 52A.

Referring now to FIG. 3C, shown in side sectional view is an alternate example of bottom-hole assembly 22A in which upper and lower subcomponents 36A, 38A are joined together by torque nut 62A; and between subcomponent 38A and housing 26A are optional bearings 71A and a seal 72A. In this embodiment, torque nut 62A is an annular elongated member having a base 74A formed on a lower terminal end and defined where a length of torque nut 62A has an enlarged outer diameter. In an alternative, torque nut 62A operates as a compression element. The diameter increase of torque nut 62A is abrupt and defines a ledge 76A shown facing upper subcomponent 36A and in a plane substantially perpendicular with axis $A_X$. Ledge 76A is illustrated in interfering contact with shoulder or ledge 65A formed on the upper end of annular space 64A. In the example of FIG. 3C, the threads 66A are on an outer surface of a portion of torque nut 62A that is distal from the base 74A. Threads 66A are shown engaged with threads 68A formed on an inner surface of a bore 80A that extends along axis $A_X$ and through upper subcomponent 36A. In an embodiment subcomponents 36A, 38A are upper and lower portions of a drive shaft that are engaged by link 40A and threaded connection 69A, the combination of the link 40A and threaded connection 69A define connection 41A. Threaded connection 69A is formed by engaging threads 66A, 68A, and link 41A is formed by intermeshing raised members 42A, 44A. In a non-limiting example of operation, the drive shaft selectively rotates relative to and within housing 26A with a rotational speed that is substantially higher than the rotational speed of housing 26A. Also in this example, the diameter of bore 80A transitions abruptly outward proximate link 40A to define an annular space 82A, and an outer diameter $D_{62A}$ of torque nut 62A is less than an outer diameter $D_{36A}$ of upper subcomponent 36A. An optional gap 83A is shown between subcomponents 36A, 38A when raised members 42A, 44A (FIG. 3A) are intermeshed and fully engaged to form link 40A, and that provides clearance in a position where respective shoulders of link 40A are not fully engaged so that raised members 42A, 44A become fully engaged. As discussed above, a maximum magnitude of the force $F_A$ exerted onto upper subcomponent 36A by threaded engagement shown is limited by diameter $D_{62A}$, which also limits torque transfer capabilities of standard box and pin connections. An advantage provided by the present disclosure is that engagement between raised members 42A and raised members 44A introduces an additional mode or path of transferring torque or rotational force between upper subcomponent 36A and lower subcomponent 38A; and which greatly increases the maximum amount of torque or rotational force transferred between upper and lower subcomponents 36A, 38A, and conversely reduces the possibility of rotational slippage between upper and lower subcomponents 36A, 38A during operations that experience expected loads. Examples exist where spaces (not shown) exist between adjacent members 42A and members 44A, in this alternative the radial surface of the shoulder 50A in one or more of the spaces lies in a plane substantially perpendicular to axis $A_X$. In another alternative, portions of members 42A are out of contact with opposing portions of members 44A.

Figure 4B:
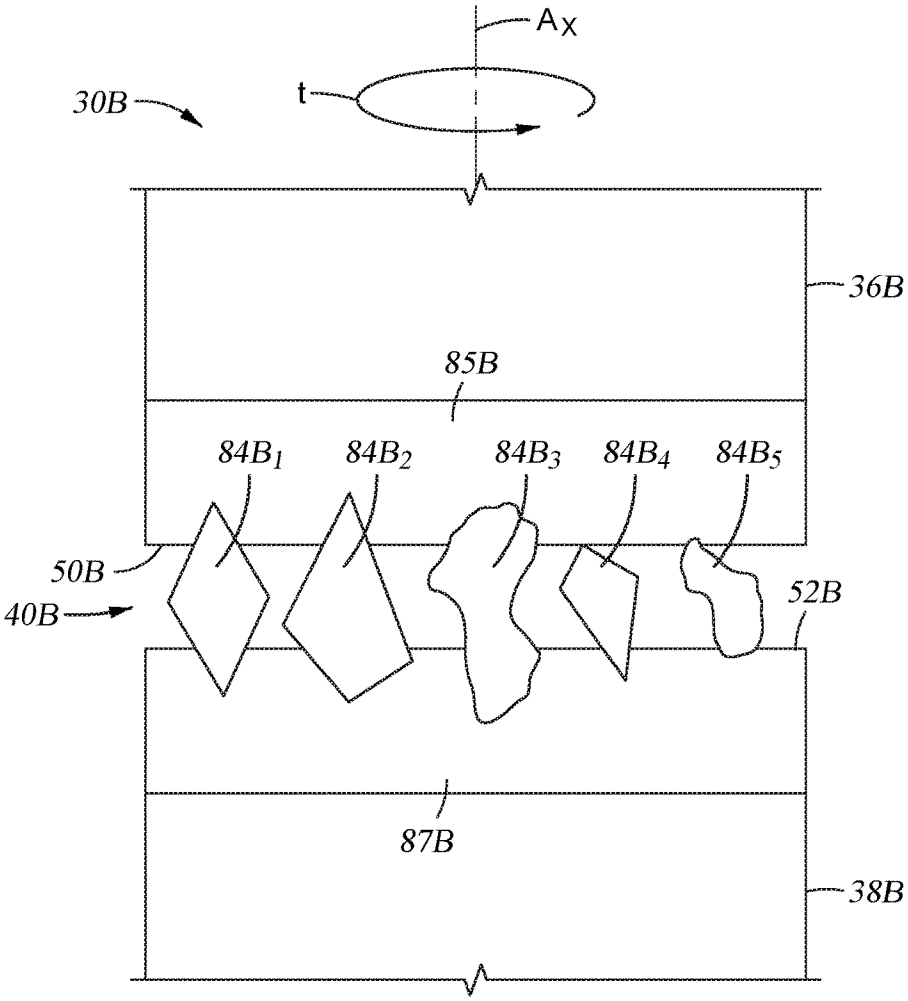
FIG. 4B is a side partial sectional view of a portion of the embodiment of the end portions of tubulars of FIG. 4A.
Figure 4A:
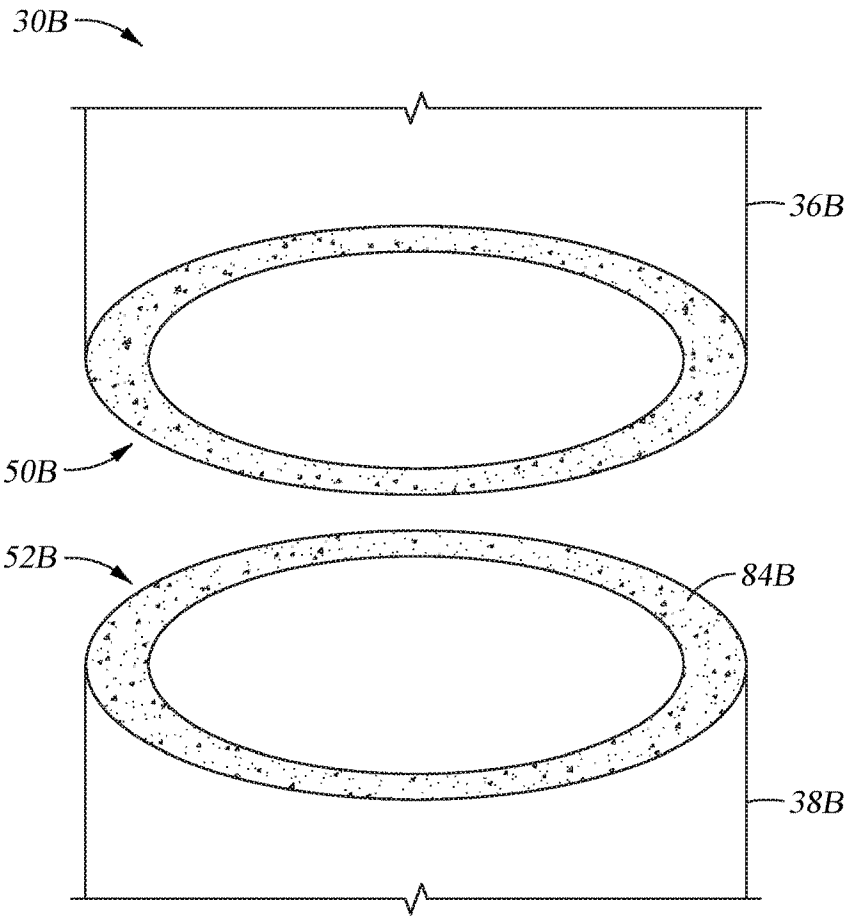
FIG. 4A is a side perspective view of an alternate example of end portions of tubulars of FIG. 2A and spaced away from another.

An alternate example of a portion of the connection assembly 30B is shown in perspective view in FIG. 4A. In this example, connection assembly 30B is shown to be substantially the same as the connection assembly 30 of FIGS. 2A-2C; and which further includes particles 84B, such as rigid particles, formed on and adhered or otherwise attached to the surface of shoulder 52B of lower subcomponent 38B; or shoulder 50B of upper subcomponent 36B; particles 84B optionally embed into the surface of shoulder 50B. The particles 84B on one or both of shoulders 50B, 52B increases rotational torque transfer between the shoulders 50B, 52B. In an embodiment, particles 84B are embedded into one or each of shoulders 50B, 52B; alternatively the particles 84B are embedded by application of an axial force, such as that created during forming the connection, e.g. forming the connection by threads, for example by threads of torque nuts similar to those shown in FIGS. 2C and 3C. Example materials of the particle 84B include diamonds, tungsten, carbides, and any other material having a hardness that is at least about that of the material making up shoulders 50B, 52B. Example sizes of the particles 84B include up to about 2 mm, up to about 1 mm, up to about 500 μm, up to about 200 μm, and up to about 100 μm. Particles 84B are another form of projections that extend out axially from one or both of shoulders 50B, 52B for engagement with an opposing one of the shoulders 50B, 52B. Other examples of projections include but are not limited to keys, teeth, rings, balls, cylinders, or particles with irregular surfaces. In an example, particles 84B are optionally included with or attached to friction shims. An example of friction shims suitable for an embodiment disclosed herein are available from 3M Advanced Materials Division, 3M Center St. Paul, Minn. 55144 USA, and described in the following website http://multimedia.3m.com/mws/media/1001697O/3m-friction-shims.pdf, the entire contents of which are incorporated by reference herein, and for all purposes. A portion of the connection assembly 30B of FIG. 4A is shown in an enlarged and partial sectional view in FIG. 4B. In FIG. 4B example particles 84$B_{1-5}$ are illustrated spanning between opposing faces of shoulders 50B, 52B. Embodiments exist where torque t is transferred from one of the shoulders 50B, 52B to the other and through or across particles 84$B_{1-5}$ that are between the shoulders 50B, 52B. As shown, some particles 84$B_{1-5}$ have diamond like shapes where portions of their outer surfaces are planar, and others have conical portions or are irregularly shaped. Shapes of the particles 84$B_{1-5}$ are not limited to the examples shown in FIG. 4B, but include any shape or configuration. Further in this example, particles 84$B_{1-3}$ have portions embedded in each of shoulders 50B, 52B; whereas particle 84$B_4$ has a portion embedded only in shoulder 52B, and no portion of particle 84$B_5$ is embedded in either of the shoulders 50B, 52B. Instead particle 84$B_5$ is illustrated wedged between shoulders 50B, 52B. Although particle 84$B_4$ is embedded in a single one of the shoulders 50B, 52B, and particle 84$B_5$ is not embedded in either of the shoulders 50B, 52B, in an example all or a portion of torque t, torsional load, or rotational force transfers between shoulders 50B, 52B through one or both of particles 84$B_{4,5}$. In an alternate embodiment, locking elements are forced into at least one of the engaged surface by applying a pre-compression by a pre-load force; pre-compressing shoulders 50B, 52B with locking elements between the shoulders 50B, 52B elastically or inelastically deforms at least one of shoulders 50B, 52B in a way that locking elements will be forced into one or both of the shoulders 50B, 52B. Optionally, one or more of a washer like ring, shim ring, bearing ring, or bearing race (not shown) are disposed on any of the above described shoulders (i.e. 50, 50A, 50B, 52, 52A, 52B), and which optionally is equipped with raised profiles and/or particles in addition to or as an alternative to raised profiles and/or particles on one or more of described shoulders (i.e. 50, 50A, 50B, 52, 52A, 52B). In a non-limiting example, the washer like ring, shim ring, bearing ring, or bearing race has raised profiles and/or particles that are made of a material that is harder than the opposing shoulders (i.e. 50, 50A, 50B, 52, 52A, 52B). In an example, the washer like ring, shim ring, bearing ring, or bearing race is made of a material that is harder than opposing shoulders (i.e. 50, 50A, 50B, 52, 52A, 52B) of upper/lower subcomponents 36B, 38B and profiles or particles are optionally made of the material of washer like ring, shim ring, bearing ring, or bearing race. In an embodiment, raised profiles and/or particles are on both sides of the washer like ring, shim ring, bearing ring, or bearing race, and alternatively the respective corresponding shoulders (i.e. 50, 50A, 50B, 52, 52A, 52B) of upper/lower subcomponents 36B, 38B have no locking elements (e.g. raised profiles/particles). In this embodiment, locking elements on washer like ring, shim ring, bearing ring, or bearing race are forced into at least one of the engaged surface of corresponding shoulders (i.e. 50, 50A, 50B, 52, 52A, 52B) of upper/lower subcomponents 36B, 38B by applying a pre-compression by a pre-load force; pre-compressing shoulders 50B, 52B with washer like ring, shim ring, bearing ring, or bearing race between the shoulders 50B, 52B elastically or in-elastically deforms at least one of shoulders 50B, 52B in a way that locking elements of washer like ring, shim ring, bearing ring, or bearing race is forced into one or both of the shoulders 50B, 52B. In this embodiment, locking elements on washer like ring, shim ring, bearing ring, or bearing race found to be worn after upper/lower subcomponents 36B, 38B are replaceable with replacement or refurbishment of the washer like ring, shim ring, bearing ring, or bearing race; which provides an advantage of time and cost efficiencies and savings over that of rework and/or replacement one or both of upper/lower subcomponents 36B, 38B. Further optionally, a material layer, such as a metal inlay or coating (e.g. nickel coating), is provided on any of the above described shoulders (i.e. 50, 50A, 50B, 52, 52A, 52B) and in which particles are embedded. Advantages provided by the locking elements prevent relative movement between opposing shoulders when drilling torque is provided through the threaded connection to the drill bit while at the same time rotation of the drill bit is generating torsional oscillations, for example high-frequency torsional oscillations at the threaded connection. An example of replaceable rings 85B, 87B are optionally included with shoulders 50B, 52B.

Figure 5B:
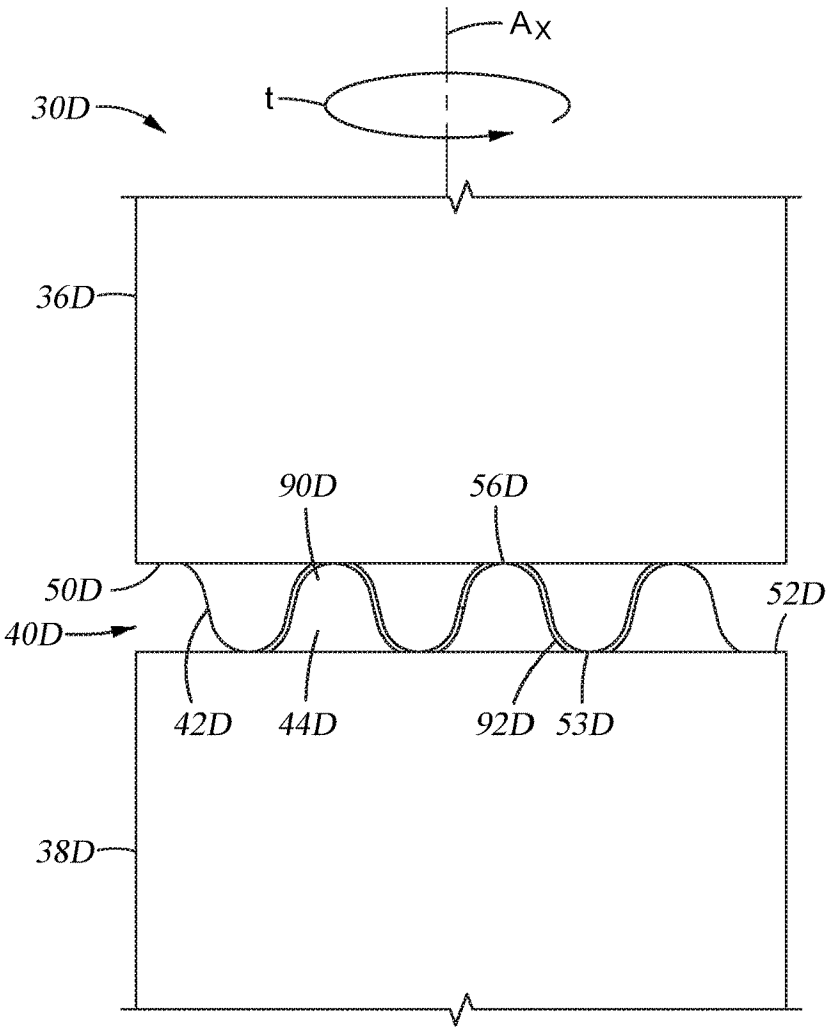
FIGS. 5A and 5B are side views of alternate examples of end portions of the tubulars of FIG. 2A.
Figure 5A:
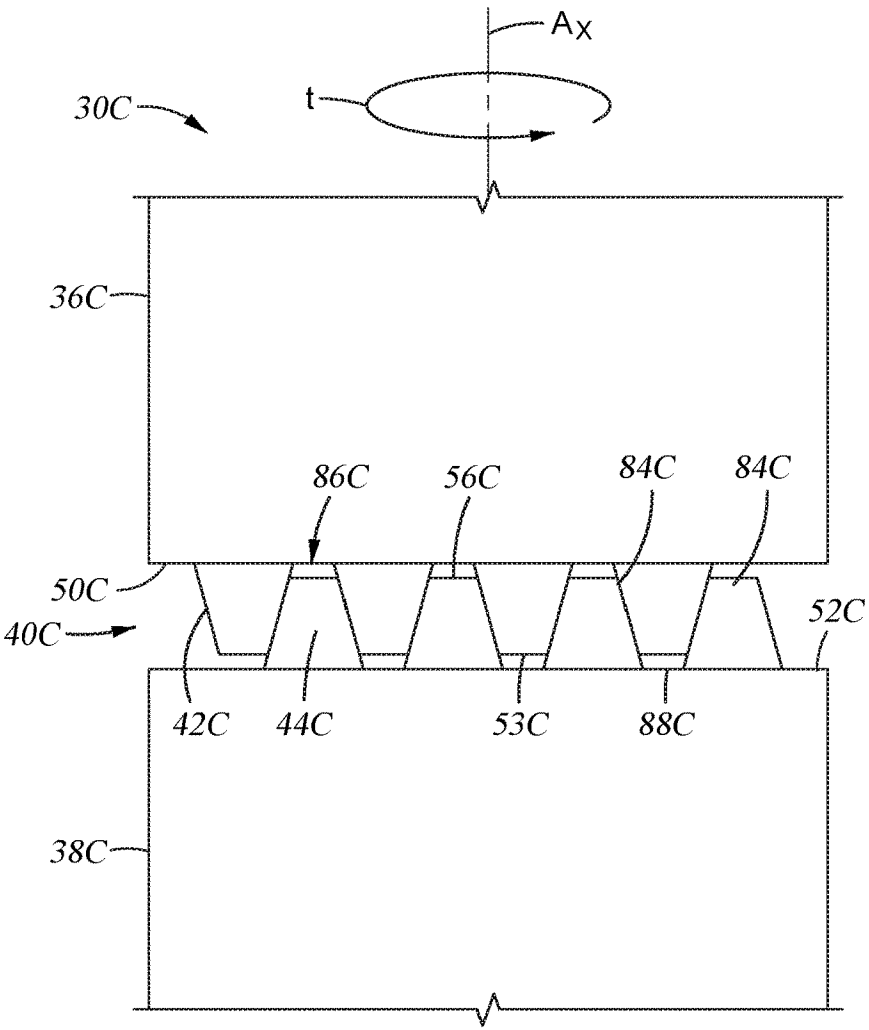

Provided in a side view in FIG. 5A is an example of a portion of the connection assembly 30C where the raised members 42C have a frusto-conical shape. As shown, the larger diameter portion of raised members 42C mounts on the shoulder 50C of upper subcomponent 36C and mesh with raised members 44C of lower subcomponent 38C. Example lengths of raised members 42C, 44C (i.e. from shoulders 50C, 52C to their free ends) include up to about 5 mm, up to about 3 mm, up to about 1 mm, up to about 800 μm, up to about 500 μm, and up to about 100 μm. Raised members 44C also have a frusto-conical configuration and with the larger diameter portion mounted to the shoulder 52C of lower subcomponent 38C. Raised members 42C are illustrated meshed with raised members 44C and positioned so that rotation of one of the upper and lower subcomponents 36C, 38C exerts a torque t of rotational force onto the other one of the upper and lower subcomponents 36C, 38C across the interface of members 42C, 44C. The tips 56C of members 44C terminate short of shoulder 50C and define spaces 86C between tips 56C and shoulder 50C. Similar spaces 88C are defined between tips 53C and shoulder 52C. In this example raised members 44C are not in contact with opposing shoulder 50C and raised members 42C are not in contact with opposing shoulder 52C when pre-compressed (i.e. when compressively preloaded); which allows for sufficient space during pre-compression, and positions shoulder 50C away from and not in contact with shoulder 52C when pre-compressed. Alternatives exist with one or more of tips 56C, 53C in contact with shoulders 50C, 52C. Shown in side view in FIG. 5B are alternate examples of raised members 42D, 44D that project respectfully from shoulders 50D, 52D. The tips 53D, 56D of raised members 42D, 44D are generally rounded and shown inserted into complementary shaped recesses between adjacent members 42D, 44D. Example lengths of raised members 42D, 44D (i.e. from shoulders 50D, 52D to their free ends) include up to about 5 mm or smaller, up to about 3 mm, up to about 1 mm, up to about 800 μm, up to about 500 μm, and up to about 100 μm. Similar to the configuration of FIG. 5A, meshing of the members 42D, 44D rotationally couples upper and lower subcomponents 36D, 38D. Also illustrated in the example of FIG. 5B are spaces 90D between tips 56C and shoulder 50D and spaces 92D between tips 53C and shoulder 52D. Optionally the tips or free ends of raised members 42D are spaced away from shoulder 52D, the tips or free ends of raised members 44D are spaced away from shoulder 50D so that raised members 44D are not in contact with opposing shoulder 50D and raised members 42D are not in contact with opposing shoulder 52D when pre-compressed to allow for sufficient space during pre-compression; also in this example shoulder 50D and shoulder 52D are not in contact, e.g. in direct contact, when pre-compressed. In an alternative, one or more of tips 53D, 56D is in contact with shoulders 50D, 52D. While FIGS. 2A and 2B were mainly discussed in relation to FIG. 2C and FIGS. 3A, 3B were mainly discussed in relation to FIG. 3C, this is not to be meant as a limitation of anything described herein; similarly, all embodiments discussed with respect to FIGS. 2A, 2B, 3A, 3B, 4A, 4B, 5A, and 5B can be advantageously used as shown and discussed with respect to FIGS. 2C, 3C, 6, and 7 (as will be discussed below).

Figure 6:
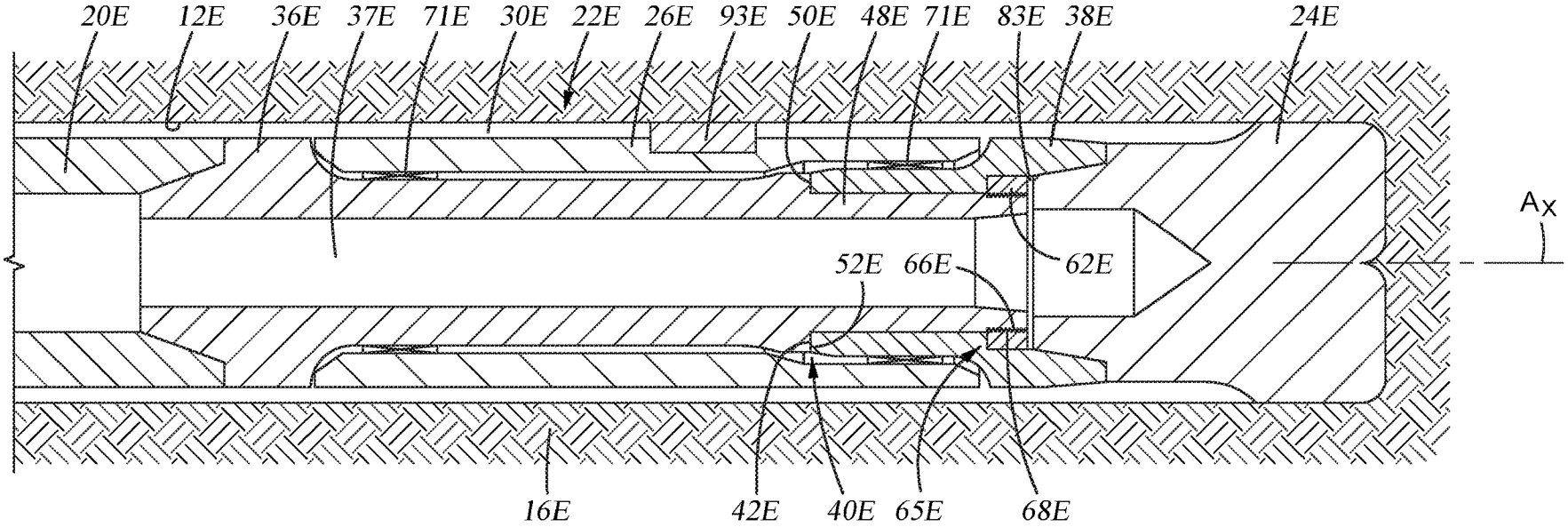
FIG. 6 is a side sectional view of an alternate example of the bottom-hole assembly of FIG. 2C.

Referring now to FIG. 6, shown in a side sectional view is an alternate example of a bottom-hole assembly 22E forming a wellbore 12E through a formation 16E. In this example, an end of tubular 20E attaches to a connection assembly 30E which includes an upper subcomponent 36E and a lower subcomponent 38E that are coupled together. Examples of tubular 20E include a drill pipe or subcomponent of bottom-hole assembly 22E. More specifically, in the example shown upper subcomponent 36E directly couples to tubular 20E, and on an end opposite upper subcomponent 36E lower subcomponent 38E is coupled to drill bit 24E. Options exist that instead of drill bit 24E, another subcomponent of bottom-hole assembly 22E is attached to the lower end of lower subcomponent 38E. In the illustrated example, upper and lower subcomponents 36E, 38E are disposed around and along common rotational or longitudinal axis $A_X$ of bottom-hole assembly 22E, and drill bit 24E is shown in direct contact with lower subcomponent 38E. Alternatively, subcomponents (not shown) are disposed between lower subcomponent 38E and drill bit 24E so that drill bit 24E is in indirect contact with lower subcomponent 38E rather than in direct contact. In a non-limiting example, tubular 20E, subcomponents 36E, 38E, and drill bit 24E rotate at the same speed about rotational or longitudinal axis $A_X$ at the same time while drill bit 24E is in direct contact with formation 16E thereby penetrating formation 16E and creating wellbore 12E. Rotation of tubular 20E, subcomponents 36E, 38E as well as drill bit 24E about rotational or longitudinal axis $A_X$ is optionally powered by surface means, or by a downhole motor such as motor 28. In a non-limiting example of operation, by rotating drill bit 24E in direct contact with formation 16E torsional oscillations (e.g. high-frequency torsional oscillations) within drill bit 24E, subcomponents 36E, 38E as well as tubular 20E are created that overlay the rotation of tubular 20E, upper and lower subcomponents 36E, 38E, and drill bit 24E about rotational or longitudinal axis $A_X$ that is generated by the surface means or downhole motor. In some instances torsional oscillations (also known as torsional vibrations) generate accelerations, for example periodic oscillations, some of which are at a magnitude to damage downhole components, such as parts, couplings, or connections. A sleeve 26E at least partially disposed around drive shaft is shown partially circumscribing adjacent portions of upper and lower subcomponents 36E, 38E. Sleeve 26E is selectively rotatably coupled to subcomponents 36E, 38E by radial and/or axial bearings 71E; by means of bearings 71E sleeve 26E is able to rotate at a different speed than subcomponents 36E and 38E. In alternatives sleeve 26E is static, or rotates relative to formation 16E at an angular velocity slower than that of subcomponents 36E, 38E. Optionally, one or more actuators 93E is schematically shown included with sleeve 26E that in an example, when actuated engage the wall of borehole 12E in order to steer bottom-hole assembly 22E and adjust or change the drilling direction. In the example shown, sleeve 26E has a maximum outer diameter that is smaller than the diameter of drill bit 24E which defines the diameter of borehole 12E. Sleeve 26E also has a minimum inner diameter depending on the required wall thickness of sleeve 26E. Similar to the example of FIG. 2C, upper and lower subcomponents 36E, 38E are coupled together with a fastener; such as a threaded fastener, the fastener shown in the example includes a torque nut 62E and a stinger 48E; in another example the fastener includes an elongated torque member 62A (e.g. a bolt with a head) as previously shown in FIG. 3C. In a non-limiting example of drilling with the downhole assembly 22E an operational torque is acting on upper subcomponent 36E and is transmitted by this coupling to lower subcomponent 38E and further to a drill bit 24E shown attached to an end of lower subcomponent 38E opposite its connection to upper subcomponent 36E. In an example, torque nut 62E (or likewise elongated torque member 62A (e.g. a bolt with a head)—as previously shown in FIG. 3C) does not transmit torque from upper subcomponent 36E to lower subcomponent 38E or from upper subcomponent 36E and/or lower subcomponent 38E to drill bit 24E. Instead, a gap 83E is defined between torque nut 62E and drill bit 24E as well as between stinger 48E and drill bit 24E to allow for full pre-compression when threading drill bit 24E to lower subcomponent 38E of the drive shaft. Optionally, upper and lower subcomponents 36E, 38E are rotating within and relative to sleeve 22E and both are transmitting the complete drilling torque (except losses due to contact between outer diameters of drive shaft members and housing or borehole). A portion of upper subcomponent 36E proximate its lower terminal end has a reduced diameter to define a stinger 48E. The outer diameter of upper subcomponent 36E abruptly transitions where the stinger 48E initiates to form a downward facing shoulder 50E. Stinger 48E is shown inserted into and circumscribed by lower subcomponent 36E and where shoulder 50E abuts shoulder 52E formed on an upper terminal end of lower subcomponent 38E. Engagement of shoulders 50E, 52E forms link 40E, and similar to link 40, 40A described above provides for the transfer of forces. In an example, a major portion of the drilling torque transferred between upper and lower subcomponents 36E, 38E occurs across link 40E, and a minor portion of the drilling torque is transmitted across the fastener (e.g. torque nut 62E and stinger 48E). Force transfer across fastener typically occurs by static friction or adhesion at mating contact faces and without further locking element. Example percentages of total torque transfer between upper and lower subcomponents 36E, 38E across the links 40A-40E range from about 50% to about 90% and all values between; and across the fastener range from about 10% to about 50% and all values between; in a specific non-limiting example the percentage of torque transfer across the links 40A-40E is about 75% and the percentage of torque transfer across the above described fasteners is about 25%. For manufacturing reasons, the outer diameter of link 40E and the engagement area of shoulders 50E and 52E is limited by the minimum inner diameter of sleeve 26E, and in examples is smaller than other RSTC within the bottom-hole assembly 22E, such as the connection between tubular 20E and upper subcomponent 36E of the drive shaft or lower subcomponent 38E and drill bit 24E. In examples, the minimum inner diameter of upper and lower subcomponents 36E and 38E of connection assembly 30E is limited to provide sufficient space for fluid flowing through inner bore 37E to drill bit 24E to cool and lubricate drill bit 24E. In this situation, the engagement area where shoulders 50E and 52E are engaged is limited and reduced compared to RSTC within the bottom-hole assembly 22E; such as the connection between tubular 20E and upper subcomponent 36E, or lower subcomponent 38E and drill bit 24E due to the maximum inner diameter of upper and lower subcomponents 36E and 38E and minimum inner diameter of sleeve 26E. The reduced engagement area does not allow the same amount of pre-compression at link 40E as at other RSTC within the bottom-hole assembly 22E, such as the connection between tubular 20E and upper subcomponent 36E of the drive shaft or lower subcomponent 38E and drill bit 24E. In addition, the ability to transmit torque t across link 40E is reduced by its lowered diameter, such as the torque that is needed to rotate upper and lower subcomponents 36E and 38E of the connection assembly 30E and drill bit 24E in contact with formation 16E plus torque created by torsional oscillations due to the rotation of drill bit 24E in contact with formation 16E, as other RSTC with larger diameters within the bottom-hole assembly 22E, such as the connection between tubular 20E and upper subcomponent 36E of the drive shaft or lower subcomponent 38E and drill bit 24E. In the special situation where link 40E between upper subcomponent 36E and lower subcomponent 38E of the drive shaft is limited between the maximum inner diameter of the drive shaft and the minimum inner diameter of sleeve 26E, one or both of shoulders 50E and 52E may be advantageously provided with torsional locking elements such as shown and described in more detail above and below. As several modes of torsional oscillations may exist within drilling assembly 22E, one or both of shoulders 50E and 52E may be advantageously provided with torsional locking elements 110E such as shown and described in more detail above and below when the link 40E is relatively close to drill bit 24E, for example when a distance between link 40E and drill bit 24E is not more than 5 m or not more than 3 m.

Still referring to FIG. 6, the torque nut 62E shown is a substantially annular member having threads 66E on an inner circumference that selectively engage threads 68E on a portion of the outer circumference of upper subcomponent 36E. Threads 68E are illustrated proximate a lower terminal end of upper subcomponent 36E. In this example, a ledge 65E is depicted on an inner surface of lower subcomponent 38E, and positioned in a mid-portion of lower subcomponent 38E. Ledge 65E is a radial surface shown facing towards drill bit 24E, and formed where a diameter of an axial bore through lower subcomponent 38E changes abruptly. A lateral end of torque nut 62E facing away from drill bit 24E abuts ledge 65E along a generally radial interface. In a non-limiting example of operation and similar to that described above, engaging threads 66E, 68E respectively on torque nut 62E and lower subcomponent 38E results in a compressive preload force for continued engagement of shoulders 50E, 52E, and link 40E provides a rotational coupling between upper and lower subcomponents 36E, 38E that restricts relative rotational movement or sliding between upper and lower subcomponents 36E, 38E. In an example relative rotational movement or sliding is due to torsional oscillations, such as high frequency torsional oscillations that are created by rotating drill bit 24E in contact with formation 16E. Link 40E further optionally includes a locking element 42E positioned between mating shoulders 50E, 52E. Further shown in FIG. 6 are radial and/or axial bearings disposed between upper subcomponent 36E and sleeve 26E, and also between lower subcomponent 38E and sleeve 26E.

Figure 7:
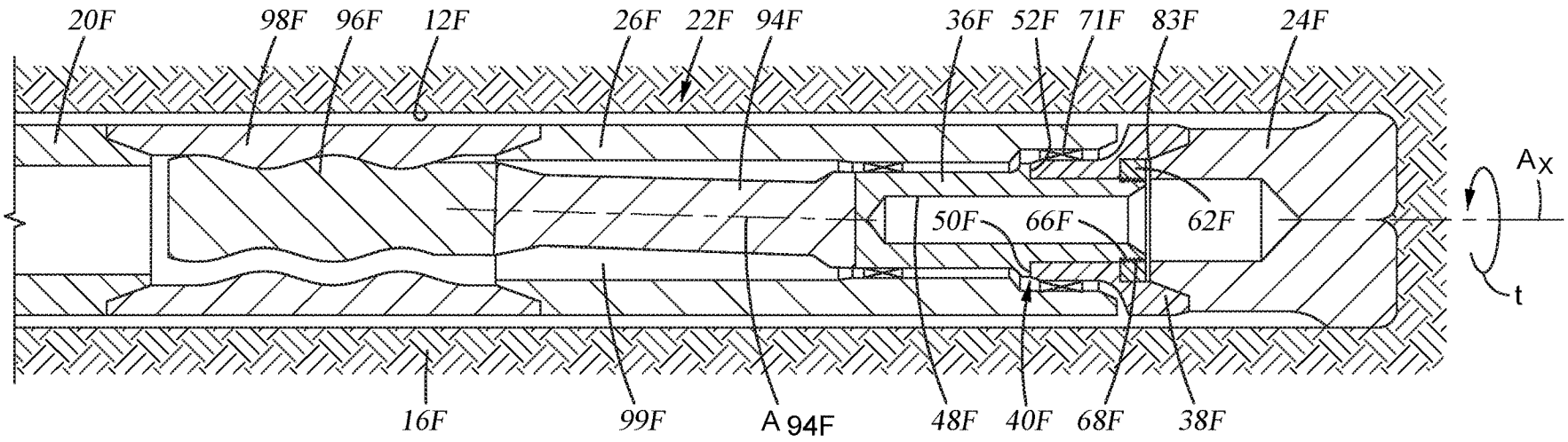
FIG. 7 is a side sectional view of an alternate example of the bottom-hole assembly of FIG. 2C.

Another alternative of a bottom-hole assembly 22F is illustrated in a side sectional view in FIG. 7, and which is in use for forming a wellbore 12F. Similar to that of FIG. 6, bottom-hole assembly 22F of FIG. 7 includes upper and lower subcomponents 36F, 38F with opposing shoulders 50F, 52F including a locking element between that form a link 40F for transferring forces and/or torque, for example more than 50% of the drilling torque between the upper and lower subcomponents 36F, 38F while being compressively preloaded by a fastener. In this example, bottom-hole assembly 22F includes an elongated flex shaft 94F shown mounted to an end of upper subcomponent 36F opposite lower subcomponent 38F which in turn is connected to drill bit 24F. As shown, upper and lower subcomponents 36F and 38F are disposed around and along common rotational or longitudinal axis $A_X$ of bottom-hole assembly 22F. In FIG. 7 drill bit 24F is shown in direct contact with lower subcomponent 38F, alternatively other subcomponents (not shown) are disposed between lower subcomponent 38F and drill bit 24F; so that drill bit 24F is indirect contact rather than in direct contact with lower subcomponent 38F. In a non-limiting example, subcomponents 36F and 38F, flex shaft 94F, as well as drill bit 24F rotate about rotational or longitudinal axis $A_X$ while drill bit 24F is in direct contact with formation 16F thereby penetrating formation 16F and creating wellbore 12F. Optionally, rotation of subcomponents 36F and 38F, flex shaft 94F, as well as drill bit 24F about rotational or longitudinal axis $A_X$ is powered by surface means or by a downhole motor such as motor 28. In alternatives, rotating drill bit 24F in direct contact with formation 16F creates torsional oscillations (e.g. high-frequency torsional oscillations) within drill bit 24F, subcomponents 36F and 38F, and flex shaft 94F that overlay the rotation of tubular 20F, upper and lower subcomponents 36F and 38F and drill bit 24F about rotational or longitudinal axis $A_X$ that is generated by the surface means or downhole motor. Torsional oscillations (also known as torsional vibrations) alternatively cause repeated high accelerations that damage downhole components such as parts or couplings/connections. A housing 26F is disposed at least partially around the drive shaft and flex shaft 94F that is rotatably connected to subcomponents 36F and/or 38F, e.g. by radial and/or bearings 71F. By means of bearings 71F housing 26F is selectively rotated at a different speed than subcomponents 36F, 38F and flex shaft 94F. In examples housing 26F is static or rotates at an angular velocity less than that of subcomponents 36F and 38F. Examples of rotation are about axis $A_X$ and with respect to formation 16F. Housing 26F has a maximum outer diameter that is smaller than the diameter of drill bit 24F which defines the diameter of borehole 12F. Housing 26F also has a minimum inner diameter depending on the required wall thickness of housing 26F. A rotor 96F on an end of flex shaft 94F opposite upper subcomponent 36F inserts into a stator 98F. Rotor 96F and stator 98F engage one another along complementary undulations formed on their respective outer and inner surfaces. Rotor 96F and stator 98F together form an example of a motor, such as motor 28 of FIG. 1. Stator 98F is shown mounted between an upper end of housing 26F and a lower end of a tubular 20F, which in an example is a drill pipe or another component of bottom-hole assembly 22F. In an embodiment, housing 26F includes one or more housing members, and optionally includes other subcomponents of a bottom-hole assembly 22F (not shown). In an example, bearings 71F facilitate transfer of an axial load from tubular 20F to drill bit 24F via stator 98F, housing 26F, and at least one of subcomponents 36F, 38F, and torque is transferred from rotor 96F via flex shaft 94F, and one or more subcomponents 36F, 38F to drill bit 24F. Wellbore fluid, such as drilling fluid, is optionally pumped through inner bore of tubular 20F, and which flows into the annular space between rotor 96F and stator 98F, the annular space between flex shaft 94F and housing 26F, the annular space between subcomponents 36F, 38F and housing, and the inner bore of subcomponents 36F and 38F to the inner bore of drill bit 24F for lubrication and cooling drill bit 24F. An example material of flex shaft 94F is a soft and relatively flexible material (e.g. titanium), in the example shown flex shaft 94F does not include an inner bore or other passage for the flow of drilling fluid. In this example, transfer of drilling fluid from the annular space between flex shaft 94F and housing 26F and inner bore of subcomponents 36F and 38F takes place through openings in upper subcomponents 36F or openings in an optional bonnet sub (not shown) between upper subcomponent 36F and flex shaft 94F. In an example of operation, rotor 96F rotates within stator 98F by flowing wellbore fluid, such as drilling fluid, through tubular 20F and into stator 98F. Rotation of rotor 96F in turn rotates flex shaft 94F, upper and lower drive upper and lower subcomponents 36F, 38F, and in one embodiment drill bit 24F. Similar to the example of FIG. 2C, upper and lower subcomponents 36F, 38F are coupled together with a fastener, such as a threaded fastener; the fastener shown in the example includes a torque nut 62F and a stinger 48F; in another example the fastener includes an elongated torque member 62F (e.g. a bolt with a head) as previously shown in FIG. 3C. In an example, when drilling an operational torque is acting on upper subcomponent 36F and is transmitted by this coupling to lower subcomponent 38F and further to a drill bit 24F shown attached to an end of lower subcomponent 38F opposite its connection to upper subcomponent 36F. In an example, torque nut 62F (or likewise elongated torque member 62F (e.g. a bolt with a head)—as previously shown in FIG. 3C) does not transmit torque from upper subcomponent 36F to lower subcomponent 38F or from upper subcomponent 36F and/or lower subcomponent 38F to drill bit 24F. Instead, a gap 83F is defined between torque nut 62F and drill bit 24E as well as between a stinger 48F and drill bit 24F to allow for full pre-compression when threading drill bit 24F to lower subcomponent 38F. Optionally, upper and lower subcomponents 36F, 38F are rotating within and relative to a housing 26F and both are transmitting the complete drilling torque (except losses due to contact between outer diameters of drive shaft members and housing 26F or borehole 12F). A portion of upper subcomponent 36F proximate its lower terminal end has a reduced diameter to define stinger 48F. The outer diameter of upper subcomponent 36F abruptly transitions where the stinger 48F initiates and which forms a downward facing shoulder 50F. Stinger 48F is shown inserted into and circumscribed by lower subcomponent 38F, and where shoulder 50F abuts shoulder 52F formed on an upper terminal end of lower subcomponent 38F. In an embodiment, engagement of shoulders 50F, 52F forms link 40F, and similar to links described above provides for the transfer of forces respectively a major portion of the drilling torque (such as about 75%) further across upper and lower subcomponents 36F, 38F. Also in this embodiment a minor remaining portion of the drilling torque (such as about 25%) is transmitted across the compression element or fastener (torque nut 62F and stinger 48F), by static friction or adhesion at mating contact faces and without further locking element. In an example, link 40F has an outer diameter that is smaller than bearing 71F, in this example link 40F includes parts of bearing 71F such as one or more bearing races between shoulders 50F and 52F. The one or more bearing races optionally have complementary shoulders to shoulders 50F and/or 52F of link 40F, and also optionally include shoulders that are complementary to shoulders of other subcomponents that are abutted by the shoulders such as other bearing races. In one example, a stack of bearing rings or races are pre-compressed between shoulders 50F and 52F of upper and lower subcomponents 36F and 38F to form link 40F. Optionally included with shoulders of bearing rings or races are torsional locking elements in a same way as discussed throughout this disclosure with respect to other subcomponents of threaded connections. In this case, the outer diameter of link 40F and the engagement area of shoulders 50F and 52F is limited by the maximum outer diameter of bearing 71F and smaller than other RSTC within the bottom-hole assembly 22E, such as the connection between tubular 20F and upper subcomponent 36F of the drive shaft or lower subcomponent 38F of the drive shaft and drill bit 24F. In addition, the minimum inner diameter of upper and lower subcomponents 36F and 38F of the drive shaft is limited to provide sufficient space for fluid flowing through inner bore 99F to drill bit 24F to cool and lubricate drill bit 24F. In this situation, the engagement area where shoulders 50F and 52F are engaged is limited and reduced compared to other RSTC within the bottom-hole assembly 22F, such as the connection between stator 94F and housing 26F or lower subcomponent 38F and drill bit 24F due to the maximum inner diameter of upper and lower subcomponents 36F and 38F of the drive shaft and maximum outer diameter of bearing 71F. The reduced engagement area does not allow the same amount of pre-compression at link 40F as at other RSTC within the bottom-hole assembly 22F, such as the connection between tubular 20F and upper subcomponent 36F of the drive shaft or lower subcomponent 38F and drill bit 24F. In addition, the reduced diameter of link 40F in turn limits a maximum torque t transferred across link 40F, such as the torque t that is needed to rotate upper and lower subcomponents 36F and 38F of the drive shaft and drill bit 24F in contact with formation 16F, plus torque created by torsional oscillations due to the rotation of drill bit 24F in contact with formation 16F. In some instances the maximum torque t transferred across link 40F is less than that of a RSTC with larger diameters within the bottom-hole assembly 22F, such as the connection between tubular 20F and upper subcomponent 36F of the drive shaft or lower subcomponent 38F and drill bit 24F. In the special situation where link 40F between upper subcomponent 36F and lower subcomponent 38F of the drive shaft is limited between the maximum inner diameter of the drive shaft and maximum outer diameter of bearing 71F, one or both of shoulders 50F and 52F (and complementary shoulders of subcomponents between shoulders 50F and 52F, e.g. bearing traces) are advantageously provided with torsional locking elements, such as shown and described in more detail above and below. In examples in which several modes of torsional oscillations exist within drilling assembly 22F, torsional locking elements are provided on one or both of shoulders 50F and 52F as shown and described in more detail above and below. Optionally, torsional locking elements are included when a distance between link 40F and drill bit 24F, is up to about 8 m, is up to about 5 m, or up to about 3 m. In an example of operation, rotor 96F rotates within stator 98F by flowing fluid through drill pipe 20F and into stator 98F. Rotation of rotor 96F causes flex shaft 94F, 96F to rotate, that in turn rotates upper and lower subcomponents 36F, 38F. In one embodiment a distance between bit 24F and link 40F ranges up to about three meters. An axis $A_{94F}$ of flex shaft 94F precesses about axis $A_X$ with rotation of flex shaft 94F.

Figure 8B:
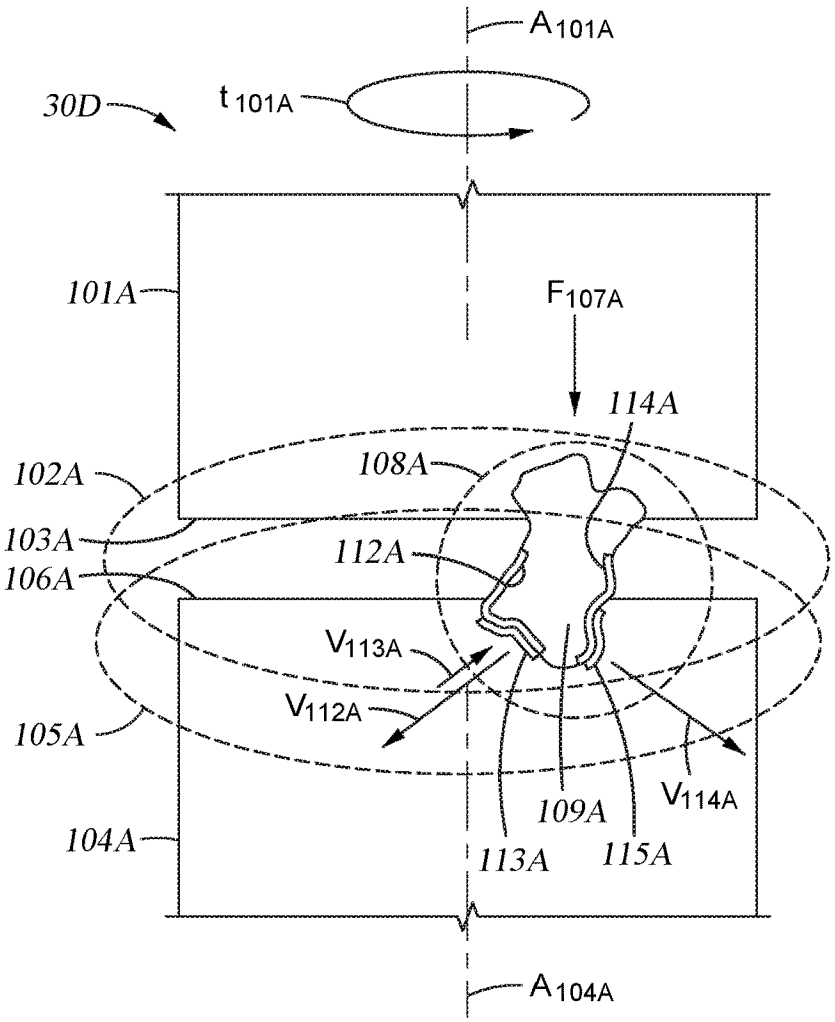
FIGS. 8A and 8B are schematic representations of force transfers between members.
Figure 8A:
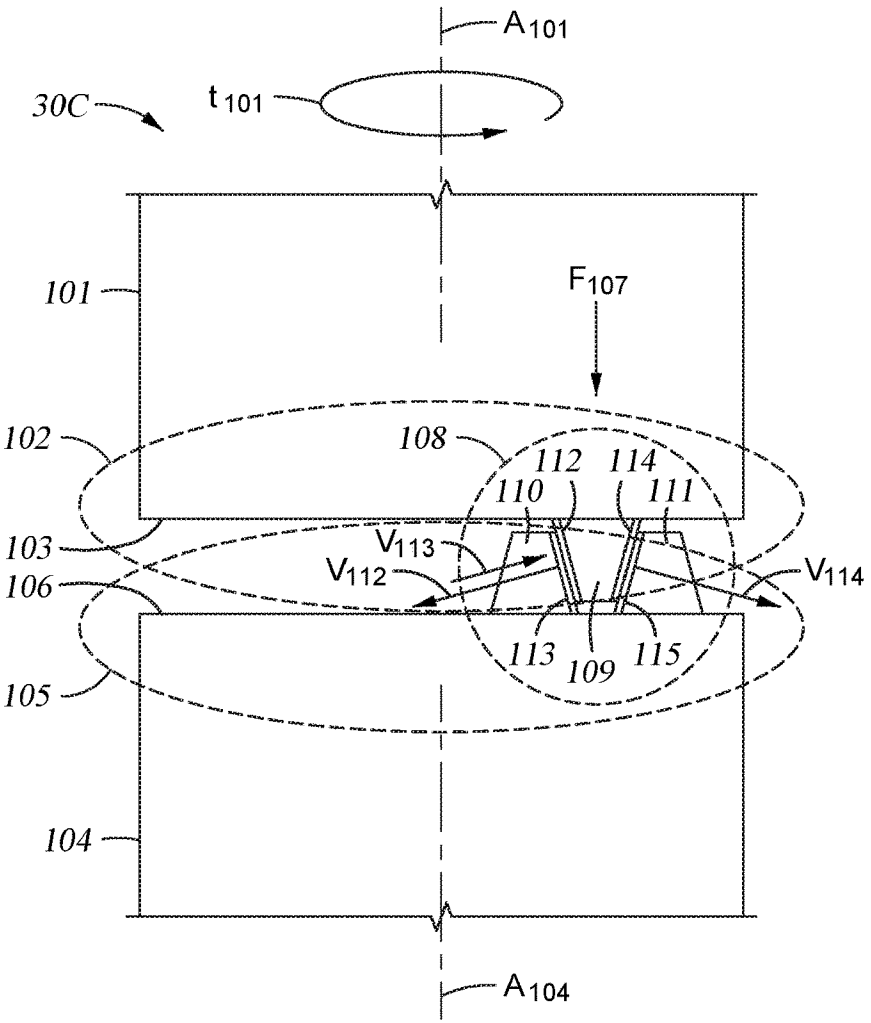

Schematically represented in FIG. 8A is a first subcomponent 101 which has a first longitudinal axis $A_{101}$ and first end 102 with a shoulder 103 similar to shoulders 50-50E described above. A second subcomponent 104 is shown spaced axially away from first subcomponent 101 and having a second longitudinal axis $A_{104}$. Second subcomponent 104 as shown further includes a second end 105 and shoulder 106 similar to shoulders 52-52E described above. A preload force $F_{107}$ is schematically shown directed axially from first subcomponent 101 and towards second subcomponent 104. An example of a locking element 108 is shown within a dashed outline, and that rotationally interlocks (micro or macro scale) mating ends 104, 105. The example locking element 108 includes a raised member 109 shown projecting axially from shoulder 103 and intermeshed between raised members 110 and raised member 111 that each project from shoulder 106. In an example, locking element 108 makes up the torsional locking element referred to above. A first surface 112 of raised member 109 is in contact with a first surface 113 of raised member 110, and a second surface 114 of raised member 109 is in contact with a second surface 115 of raised member 111. Surfaces 112, 113, 114, 115 are shown as being planar and oriented generally oblique with axis $A_{104}$. A first surface vector $V_{112}$ and a second surface vector $V_{114}$ are schematically represented as arrows extending in a direction generally perpendicular with first and second surfaces 112, 114 respectively. Also schematically shown is surface vector $V_{113}$ that is directionally opposite first surface vector $V_{112}$, and torque $t_{101}$ representing rotational torque of section 101 and about axis $A_{101}$.

Similarly, schematically represented in FIG. 8B is a first subcomponent 101A which has a first longitudinal axis $A_{101}$ and a first end 102A having a shoulder 103A similar to shoulder 103 of FIG. 8A. A second subcomponent 104A is spaced away from first subcomponent 101A and has a second longitudinal axis $A_{104A}$, a second end 105A of second subcomponent 104A faces second end 103A and includes a shoulder 106A similar to shoulder 106 of FIG. 8A. A preload force $F_{107A}$ is schematically represented directed axially from first subcomponent 101A to second subcomponent 104A. A locking element 108A is represented within a dashed outline, and which includes an irregularly shaped member 109A in contact with shoulder 103A and partially embedded in shoulder 106A. A first surface 112A of member 109A engages a second surface 113A that is within shoulder 106A, and a second surface 114A of member 109A shown facing away from first surface 112A is in contact with a second surface 115A also within shoulder 106A. A first surface vector $V_{112A}$ and a second surface vector $V_{114A}$ are schematically represented as arrows extending in a direction generally perpendicular with first and second surfaces 112A, 114A respectively. Also schematically shown is surface vector $V_{113A}$ that is directionally opposite first surface vector $V_{112A}$, and torque $t_{101A}$ representing rotational torque of section 101A and about axis $A_{101A}$.

An advantage realized with the present disclosure is the hindrance or prevention of sliding (cyclic or otherwise), e.g. torsional or rotational sliding, between opposing surfaces of a connection, such as a connection between a pair of tubulars and one of the tubulars is rotating in response to rotation of the other tubular. An example of opposing surfaces include the shoulders in connections in a RSTC that are otherwise subject to sliding when subjected to cyclic torsional loading like HFTO. In FIG. 2D a ring 116-116F (e.g. a washer ring, a shim ring, a bearing ring, or race, or any other component) with surfaces 118-118F and 120-120F is shown optionally inserted between shoulder 50-50F of lower subcomponenet 36-36F and with torsional locking elements 42-42F and shoulder 52-52F of lower subcompenent 38-38F with torsional locking elements 44-44F, and being as well compressively preloaded by the fastener. In an alternative, ring 116-116F is part of the locking element, as described above in detail and optionally disposed between at least one or any mating shoulders to prevent rotational sliding; in a specific examples such as between upper drive shaft shoulder 50F and a ring shoulder; or between mating ring shoulders (in case of multiple rings). Similar modifications to presently known driveshaft connections of a downhole motor or rotary steering system also present significant advantages. As such, the damage to shoulders and cracks of currently known connections is avoided with implementation of techniques described herein.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

Set forth below are some embodiments of the foregoing disclosure:

Embodiment 1. A downhole assembly comprising: an axis; a first tubular member; a second tubular member; a fastener in selective simultaneous engagement with the first and second tubular members, the fastener, having a diameter less than diameters of the first and second tubulars, that is in interfering contact with the second tubular member, and selectively configured to be in axial compression; a first contact surface on the first tubular member; a second contact surface on the second tubular member that is engaged with the first contact surface when the fastener is in axial compression; a first profile on the first contact surface comprising facets; and a second profile on the second contact surface comprising facets that are complementary to the facets of the first profile and abut the facets of the first profile.

Embodiment 2. The downhole assembly of Embodiment 1, wherein the first and second profiles comprise raised members on the first and second contact surfaces, and wherein the facets comprise lateral sides of the raised members.

Embodiment 3. The downhole assembly of any prior embodiment, wherein an elongated stinger extends axially from the first tubular member and inserts into a bore in the second tubular member, and wherein the fastener threadingly engages an end of the stinger distal from the first tubular member.

Embodiment 4. The downhole assembly of any prior embodiment, wherein the fastener is disposed in an annular space defined where a radius of the bore is increased along a portion of the second tubular member, and where the fastener is in interfering contact with a shoulder that is formed at an end of the annular space.

Embodiment 5. The downhole assembly of any prior embodiment, wherein the fastener comprises an annular member disposed in a bore in the second tubular member, and wherein the fastener is in selective engagement with an inner diameter of the first tubular member.

Embodiment 6. The downhole assembly of any prior embodiment, wherein an outer diameter of the fastener is increased along a portion of the fastener distal from the first tubular member to define a raised collar, and wherein the raised collar is disposed in an annular space that circumscribes a portion of the bore.

Embodiment 7. The downhole assembly of any prior embodiment, wherein a lateral side of the raised collar facing the first tubular member is in interfering contact with a shoulder defined at an end of the annular space.

Embodiment 8. The downhole assembly of any prior embodiment, wherein the assembly comprises a drilling motor and is attached to a drill bit that is selectively disposed in a wellbore.

Embodiment 9. The downhole assembly of any prior embodiment, wherein the first tubular member comprises an upper drive shaft, and wherein the second tubular member comprises a lower drive shaft.

Embodiment 10. The downhole assembly of any prior embodiment, wherein the first and second contact surfaces are each in planes that are substantially perpendicular with the axis.

Embodiment 11. A downhole assembly comprising: a first tubular member; a second tubular member selectively engaged with the first tubular member with a coupling having an outer radius that is less than an outer radius of the first tubular member and an outer radius of the second tubular member; an interface between the first and second tubular members, and across which a rotational torque between the first and second tubular members is transmitted; first and second shoulders respectively provided on the first and second tubular members, the first and second shoulders in selective engagement with one another when the interface is formed; and projections on at least one of the first and second shoulders, and through which a portion of rotational torque between the first and second tubular members is transmitted.

Embodiment 12. The downhole assembly of any prior embodiment, wherein the projections comprise a first set of raised members that project axially from the first shoulder, and have lateral sides that are oriented oblique with an axis of the first tubular member.

Embodiment 13. The downhole assembly of any prior embodiment, wherein the projections further comprise a second set of raised members that project axially from the second shoulder, and have lateral sides that are complementary to the lateral sides on the first set of raised members.

Embodiment 14. The downhole assembly of any prior embodiment, wherein the coupling comprises an annular fastener having a portion threaded to the first tubular member, and a distal portion in compressive engagement with the second tubular member.

Embodiment 15. The downhole assembly of any prior embodiment, wherein the annular fastener is in compression when the first and second tubular members are engaged.

Embodiment 16. The downhole assembly of any prior embodiment, wherein the projections comprise particles on a first surface of the first shoulder, and that press into a second surface on the second shoulder when the first and second tubular members are engaged.

Embodiment 17. The downhole assembly of any prior embodiment, wherein the particles are embedded in the first surface.

Embodiment 18. The downhole assembly of any prior embodiment, wherein the interface comprises the coupling and the first and second shoulders.

Embodiment 19. The downhole assembly of any prior embodiment, wherein the shoulders are annular and circumscribe the coupling.

Embodiment 20. A downhole drilling assembly comprising: a first shaft member section having a first longitudinal axis; a second shaft member section having a second longitudinal axis; a drill bit at an end; one of the first and second shaft member sections torsionally fixedly connected to the drill bit; a housing; at least one of the first and the second shaft member sections disposed within the housing; the first and the second shaft member sections connected to transmit torque to the drill bit through a connection; the connection comprising a first end of first shaft member section and a second end of second shaft member section engaged with each other by a preload force that has a component that is parallel to one of the first and the second longitudinal axis; the engagement obtained by relative movement of both ends parallel to one of first and second longitudinal axis towards each other and without rotation against each other; a locking element creating a rotational interlock with at least a part of at least one of the two ends; the locking element comprising a first and a second surface at the first end each defined by at least one surface vector, each of the at least two surface vectors having a component that is perpendicular to the first longitudinal axis; a third and a forth surface at the second end each defined by at least one surface vector, each of the at least two surface vectors having a component that is perpendicular to the second longitudinal axis; the first and the third surface engaged with each other, defining a first pair of engaged surfaces and a first continuous contact area at which a first impact force is transmitted under torque; the second and the forth surface engaged with each other, defining a second pair of engaged surfaces and a second continuous contact area at which a second impact force is transmitted under torque; each center of first and second continuous contact areas being eccentrically to first and second longitudinal axis; each of the first and the second impact forces having a component that is perpendicular to one of first and second longitudinal axis.

What is claimed is:

1. A downhole assembly comprising:

a drill bit;

a tubular member;

a shaft connected to the drill bit and configured to rotate within and relative to the tubular member to rotate the drill bit; and the shaft comprising, a first shaft member with a first shoulder, and a second shaft member selectively coupled to the first shaft member by a threaded connection that is spaced away from the first shoulder, the second shaft member having a second shoulder; and a ring element between the first and second shaft members, the ring element having a first surface engaged with the first shoulder, a second surface engaged with the second shoulder, and one or more torsional locking elements disposed between the first shoulder and the first surface and between the second shoulder and the second surface, the one or more torsional locking elements are made of material that is harder than at least one of the first shoulder, the second shoulder, and the ring element.

2. The downhole assembly of claim 1, wherein the one or more torsional locking elements comprise raised members on at least one of the first and second shoulders areas.

3. The downhole assembly of claim 1, wherein the threaded connection is a connection with a compression element.

4. The downhole assembly of claim 1, wherein the shaft and the tubular member are coupled by one or more bearings between the shaft and the tubular member.

5. The downhole assembly of claim 1, wherein the first and second shoulders areas are under compression when engaged.

6. The downhole assembly of claim 1, wherein the one or more torsional locking elements comprise particles on of one of the first and second shoulders, wherein the particles press into the other of the first and second shoulders when the first and second shoulders are engaged.

7. The downhole assembly of claim 1, wherein the threaded connection has an outer diameter and the tubular member has an inner diameter and wherein the outer diameter of the threaded connection is smaller than the inner diameter of the tubular member.

8. The downhole assembly of claim 1, wherein the assembly comprises a drilling motor, the drilling motor comprising a stator and a rotor and wherein the shaft is connected to the rotor.

9. The downhole assembly of claim 1, wherein a first engagement area is defined where the first surface is engaged with the first shoulder, a second engagement area is defined where the second surface is engaged with the second shoulder, and wherein the first and second engagement areas are at a distance of less than 5 m to the drill bit.

* * * * *